US011318766B2

(12) United States Patent
Koyano

(10) Patent No.: US 11,318,766 B2
(45) Date of Patent: May 3, 2022

(54) LIQUID JET HEAD AND LIQUID JET RECORDING DEVICE

(71) Applicant: SII PRINTEK INC., Chiba (JP)

(72) Inventor: Takanori Koyano, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 17/039,282

(22) Filed: Sep. 30, 2020

(65) Prior Publication Data

US 2021/0114386 A1 Apr. 22, 2021

(30) Foreign Application Priority Data

Oct. 16, 2019 (JP) ..... JP2019-189449

(51) Int. Cl.
*B41J 25/00* (2006.01)

(52) U.S. Cl.
CPC ..... *B41J 25/001* (2013.01)

(58) Field of Classification Search
None
See application file for complete search history.

(56) References Cited

U.S. PATENT DOCUMENTS

| | | | | |
|---|---|---|---|---|
| 2002/0024554 | A1* | 2/2002 | Tominaga | B41J 2/14 347/37 |
| 2010/0231974 | A1 | 9/2010 | Kakigahara et al. | |
| 2012/0044296 | A1 | 2/2012 | Gouch et al. | |

FOREIGN PATENT DOCUMENTS

| | | | |
|---|---|---|---|
| EP | 2998118 | A1 | 3/2016 |
| JP | 2006-212791 | A | 8/2006 |
| JP | 2011-136507 | A | 7/2011 |
| WO | WO 2015/037529 | A1 | 3/2015 |

OTHER PUBLICATIONS

Extended European Search Report in Europe Application No. 20202171.3, dated Jun. 28, 2021, 16 pages.

* cited by examiner

*Primary Examiner* — Alejandro Valencia
(74) *Attorney, Agent, or Firm* — Crowell & Moring LLP

(57) ABSTRACT

An alignment of jet holes of a liquid jet head is smoothly performed. A liquid jet head according to an embodiment of the present disclosure includes a nozzle section having a jet hole for liquid, a support member configured to support the nozzle section, and a position adjustment mechanism configured to adjust a position of the jet hole with respect to a carriage. The position adjustment mechanism includes a reference member a position of which with respect to the carriage is fixable, a position adjustment member which is coupled to the support member, and is configured to push the reference member to change a relative distance with respect to the reference member to thereby displace the support member on the carriage, and an intermediary member intervening between the reference member and the position adjustment member. The intermediary member is attached to either one of the reference member and the position adjustment member to form a first pressure-receiving surface facing to a displacement direction of the support member, and the other of the reference member and the position adjustment member has contact with the first pressure-receiving surface.

17 Claims, 21 Drawing Sheets

LIQUID JET HEAD AND LIQUID JET RECORDING DEVICE

RELATED APPLICATIONS

This application claims priority to Japanese Patent Application No. 2019-189449, filed on Oct. 16, 2019, the entire content of which is incorporated herein by reference.

BACKGROUND OF THE INVENTION

1. Field of the Invention

The present disclosure relates to a liquid jet head and a liquid jet recording device.

2. Description of the Related Art

As a liquid jet recording device, there can be cited an inkjet type recording device for spraying ink onto a recording target medium such as recording paper to perform recording of images, characters, or the like. In the liquid jet recording device of this type, the ink is supplied from an ink tank to an inkjet head. Then, by jetting the ink from a plurality of nozzle holes provided to the inkjet head toward the recording target medium, recording of the images, the characters, or the like is performed.

The inkjet head is provided with a nozzle array constituted by a plurality of nozzle holes arranged along a predetermined direction. Further, inside the liquid jet recording device, the nozzle array is disposed at a predetermined position with respect to a carriage. As an alignment technology used when arranging the nozzle array, there has already existed what makes the inkjet head make a relative displacement to the carriage due to an operation of an eccentric part to achieve the alignment of the nozzle holes or the nozzle array (JP-A-2006-212791).

In Patent Application No. 2019-107218 having already been submitted to Japan Patent Office by the applicant of the present application, there is described a position adjustment mechanism of a liquid jet head (nozzle holes in essence) provided with a member the position in a planar direction of which is fixed with respect to a carriage. Here, by forming a fixed point with respect to the carriage using such a member and then pushing the fixed point with an adjustment member separately provided to the liquid jet head side, it is possible to realize an alignment in a different direction from that in the mechanism described above.

However, the pressing point by the adjustment member with respect to the member on the carriage side is shifted depending on the positional relationship between the both members in some cases, and in this case, there is a concern that it becomes unachievable to smoothly perform the alignment of the nozzle holes since the displacement in other directions than the desired direction occurs in the liquid jet nozzles.

Therefore, it is desirable to provide a liquid jet head and a liquid jet recording device taking such a problem into consideration.

SUMMARY OF THE INVENTION

In one aspect of the present disclosure, there is provided a liquid jet head to be installed in a carriage of a liquid jet recording device. The liquid jet head according to the present aspect includes a nozzle section having a jet hole for liquid, a support member configured to support the nozzle section, and a position adjustment mechanism configured to adjust a position of the jet hole with respect to the carriage. The position adjustment mechanism includes a reference member a position of which with respect to the carriage is fixable, a position adjustment member which is coupled to the support member, and is configured to push the reference member to change a relative distance with respect to the reference member to thereby displace the support member on the carriage, and an intermediary member intervening between the reference member and the position adjustment member. The intermediary member is attached to either one of the reference member and the position adjustment member to form a first pressure-receiving surface facing to a displacement direction of the support member, and the other of the reference member and the position adjustment member has contact with the first pressure-receiving surface.

In another aspect of the present disclosure, there is provided a liquid jet recording device including the liquid jet head according to the above aspect, the carriage to which the liquid jet head is attached, and a drive mechanism configured to move the carriage with respect to a print medium.

According to the liquid jet head related to one aspect of the present disclosure and the liquid jet recording device equipped with the liquid jet head, since a substantive pressing point of the position adjustment member with respect to the reference member is formed on the first pressure-receiving surface of the intermediary member, it becomes possible to move the support member in the desired direction (specifically, the direction in which the first pressure-receiving surface faces) with respect to the carriage irrespective of the positional relationship between the both members, and therefore, it is possible to smoothly perform the position adjustment of the nozzle holes.

DETAILED DESCRIPTION OF THE PREFERRED EMBODIMENTS

An embodiment of the present disclosure will hereinafter be described in detail with reference to the drawings.

1. First Embodiment

[Overall Configuration of Printer 1]

Figure 1:
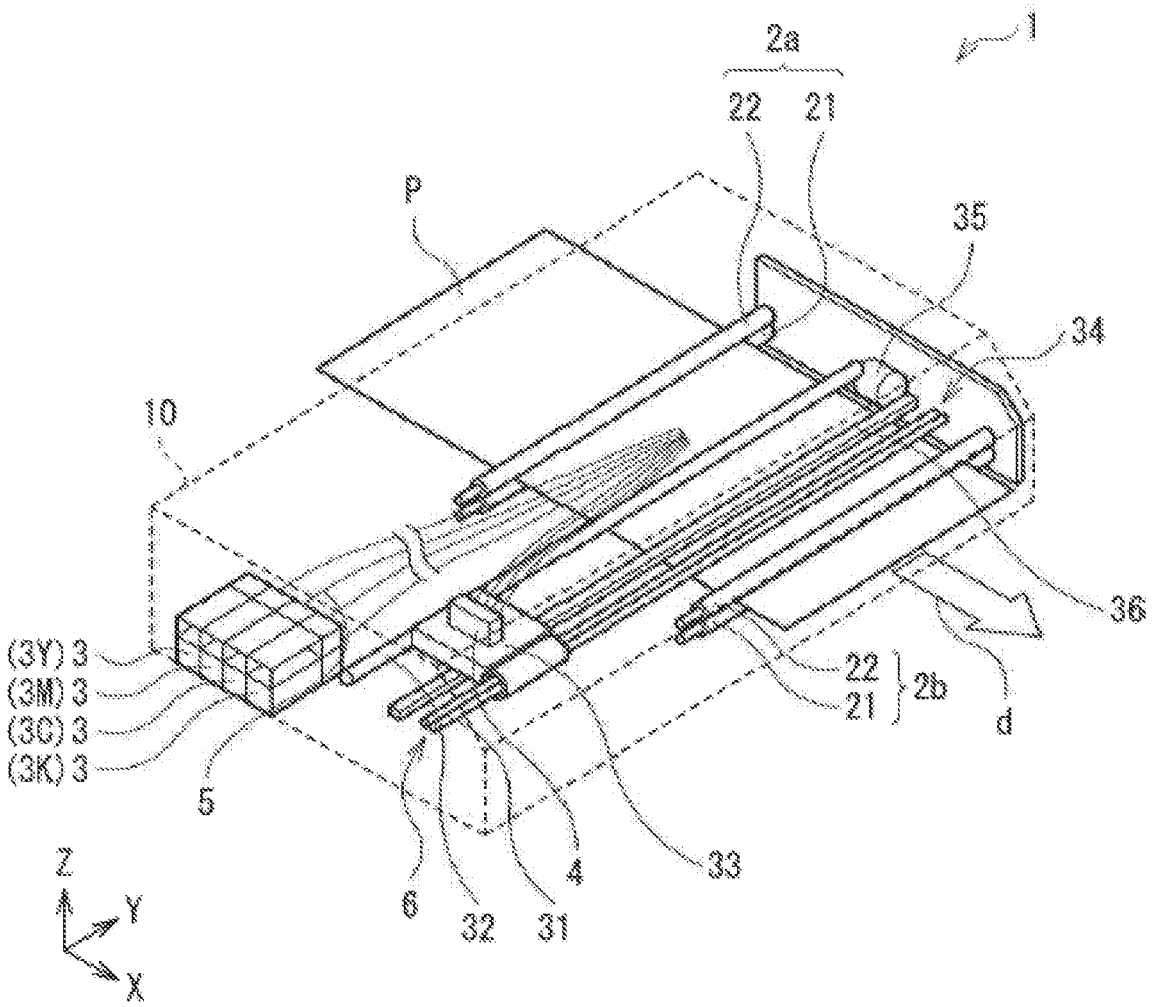
FIG. 1 is a perspective view schematically showing an internal structure of a printer according to an embodiment of the present disclosure.

FIG. 1 schematically shows an internal structure of a printer 1 according to the embodiment of the present disclosure with a perspective view. The printer 1 is an inkjet-type printer for performing recording (printing) of images, characters, or the like with ink on recording paper P as a recording target medium.

As shown in FIG. 1, the printer 1 is provided with a pair of carrying mechanisms 2*a*, 2*b*, ink tanks 3, inkjet heads 4, supply tubes 5, and a scanning mechanism 6. These components or members are housed in a chassis 10 the outer shape of which is schematically represented by the dotted lines in FIG. 1. Here, in each of the drawings hereinafter referred to, the sizes of the components of the members are arbitrarily changed for the sake of convenience of illustration, and the proportions between the components and so on, or the proportions of the components and so on to the whole of the printer 1 do not accurately represent the actual scale sizes.

The printer 1 is a specific example of the "liquid jet recording device" according to the present disclosure, and the inkjet heads 4 are each a specific example of the "liquid jet head" according to the present disclosure.

(Carrying Mechanisms 2*a*, 2*b*)

The carrying mechanisms 2*a*, 2*b* carry the recording paper P along a predetermined carrying direction d (an X direction in FIG. 1). The carrying mechanisms 2*a*, 2*b* are each provided with a grit roller 21 and a pinch roller 22, and at the same time, provided with a drive mechanism not shown. The grit roller 21 and the pinch roller 22 are each disposed so that the rotational axis thereof is parallel to a Y direction (a direction traversing the recording paper P in a width direction thereof, and a direction perpendicular to the carrying direction d of the recording paper P). The drive mechanism is a mechanism for driving the grit roller 21 to rotate the grit roller 21 around the axis, namely in a Z-X plane, and is provided with, for example, an electric motor as a power source. In the present embodiment, the electric motor and the grit roller 21 are coupled to each other via an arbitrary power transmission medium.

(Ink Tanks 3)

The ink tanks 3 contain the ink color by color. In the present embodiment, as the ink tanks 3, there are disposed four types of ink tanks 3Y, 3M, 3C, and 3K for individually containing the ink of a plurality of colors such as four colors of yellow (Y), magenta (M), cyan (C), and black (K). These ink tanks 3Y, 3M, 3C, and 3K are arranged side by side in the X direction inside the chassis 10. The ink tanks 3Y, 3M, 3C, and 3K all have the same configuration except the color of the ink contained. Therefore, in the following description, the generic term of ink tank 3 is used.

(Inkjet Heads 4)

The inkjet heads 4 each have a plurality of jet holes, and each jet the ink received from the ink tank 3 via the supply tube 5 from the plurality of jet holes toward the recording paper P as droplets to perform the recording of the images, the characters, or the like. In the present embodiment, there are disposed two or more, for example, twelve inkjet heads 4 (see FIG. 2), and each of the inkjet heads 4 is supplied with the ink of one or two colors of yellow, magenta, cyan, and black. The number of the inkjet heads 4 provided to the printer 1 is not limited to twelve, and can be larger than twelve or can also be smaller than twelve.

(Scanning Mechanism 6)

The scanning mechanism 6 makes the inkjet heads 4 perform the scanning action in the width direction of the recording paper P (i.e., the Y direction). The scanning mechanism 6 is provided with a pair of guide rails 31, 32, a carriage 33, and a drive mechanism 34, wherein the pair of guide rails 31, 32 extend in the Y direction, the carriage 33 is supported so as to be able to move on the pair of guide rails 31, 32, and the drive mechanism 34 moves the carriage 33 in the Y direction. The drive mechanism 34 is provided with an electric motor 35 as a power source, and at the same time, provided with an end-less belt 36 spanning a pair of pulleys not shown. The carriage 33 is attached to the end-less belt 36, and by the power of the electric motor 35 being transmitted to the carriage 33 via the end-less belt 36, the carriage 33 moves on the guide rails 31, 32 in the Y direction.

In the present embodiment, the scanning mechanism 6 and the carrying mechanisms 2*a*, 2*b* described above constitute a specific example of the "drive mechanism" related to the present disclosure for relatively moving the inkjet heads 4 and the recording paper P in an X-Y plane.

(Carriage 33)

Figure 2:
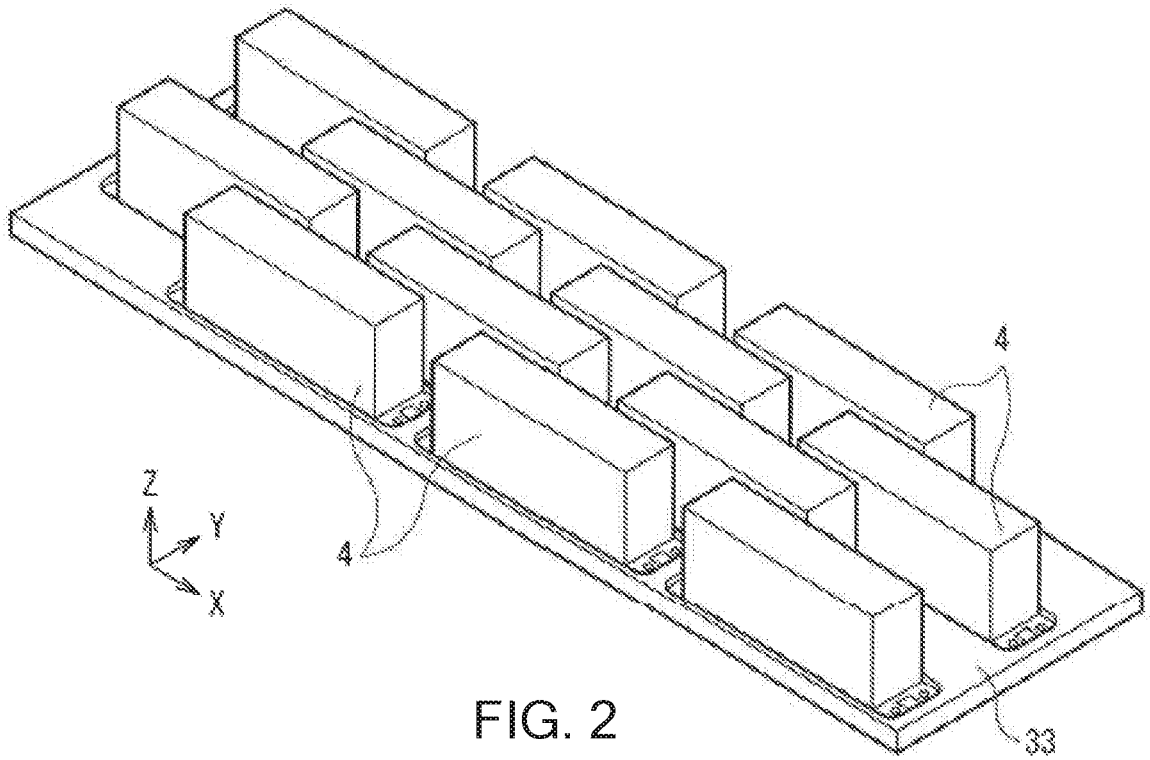
FIG. 2 is a perspective view of an inkjet head and a carriage provided to the printer shown in FIG. 1.
Figure 3:
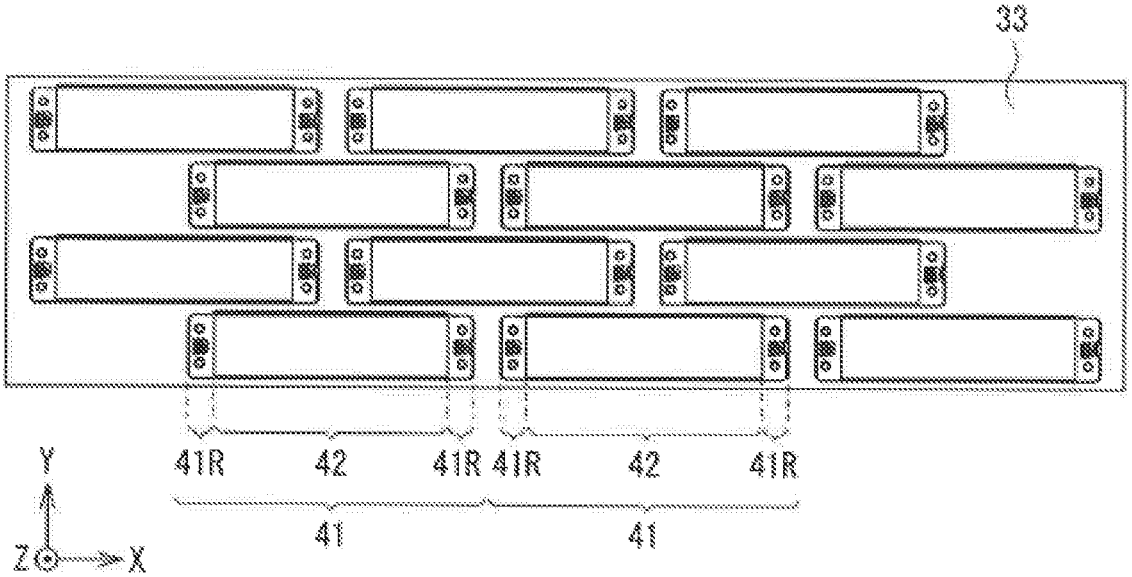
FIG. 3 is a plan view of the ink jet head and the carriage shown in FIG. 2.

FIG. 2 and FIG. 3 show the carriage 33 to which the plurality of inkjet heads 4 is attached, FIG. 2 shows the carriage 33 in such a state with a perspective view, and FIG. 3 shows the carriage 33 in such a state with a plan view.

In the present embodiment, the two or more, specifically twelve, inkjet heads 4 are attached to the carriage 33. The inkjet heads 4 each form a rectangular solid shape as a whole, and in a plan view perpendicular to the X-Y plane, the long sides of the inkjet head 4 are disposed in the X direction, and the short sides of the inkjet head 4 are disposed in the Y direction. In such an arrangement, three inkjet heads 4 are disposed along the X direction of the carriage 33, and four inkjet heads 4 are disposed in the Y direction thereof. The three inkjet heads 4 arranged in the X direction are aligned with each other in the Y direction, and the four inkjet heads 4 arranged in the Y direction are disposed in a zigzag manner. As described above, in the carriage 33, the plurality of inkjet heads 4 is arranged in the Y direction in a zigzag manner.

[Detailed Configuration of Inkjet Heads 4]

Figure 4:
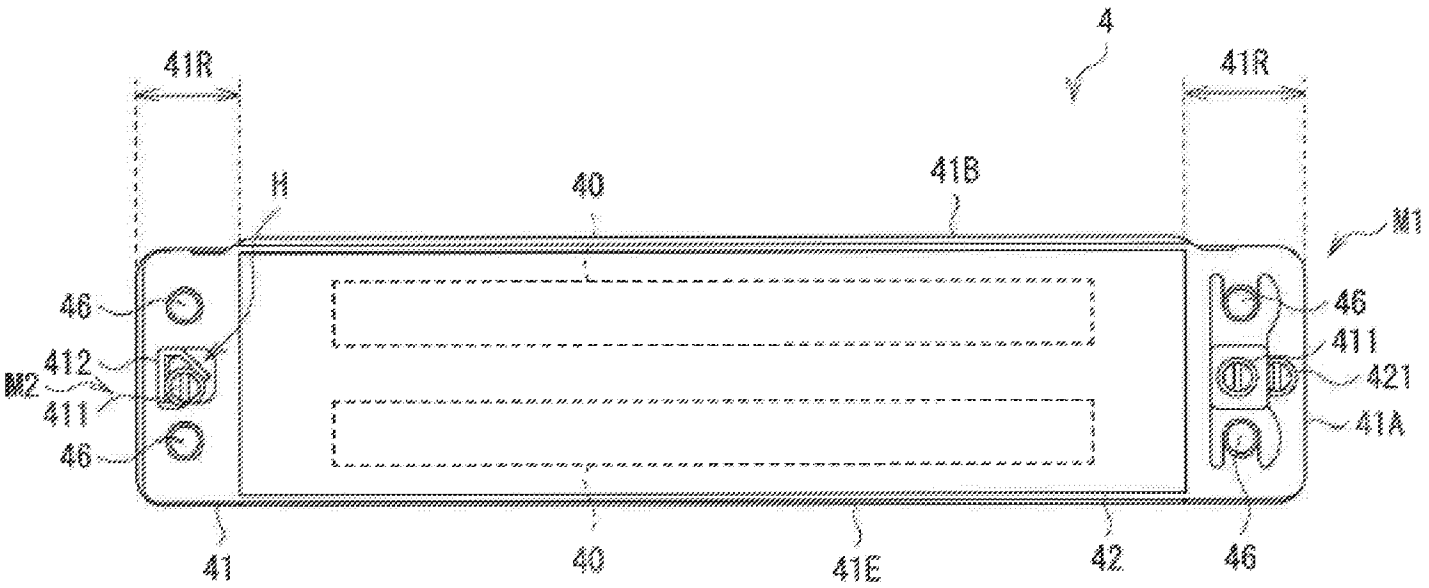
FIG. 4 is a plan view of the ink jet head shown in FIG. 3.
Figure 5:
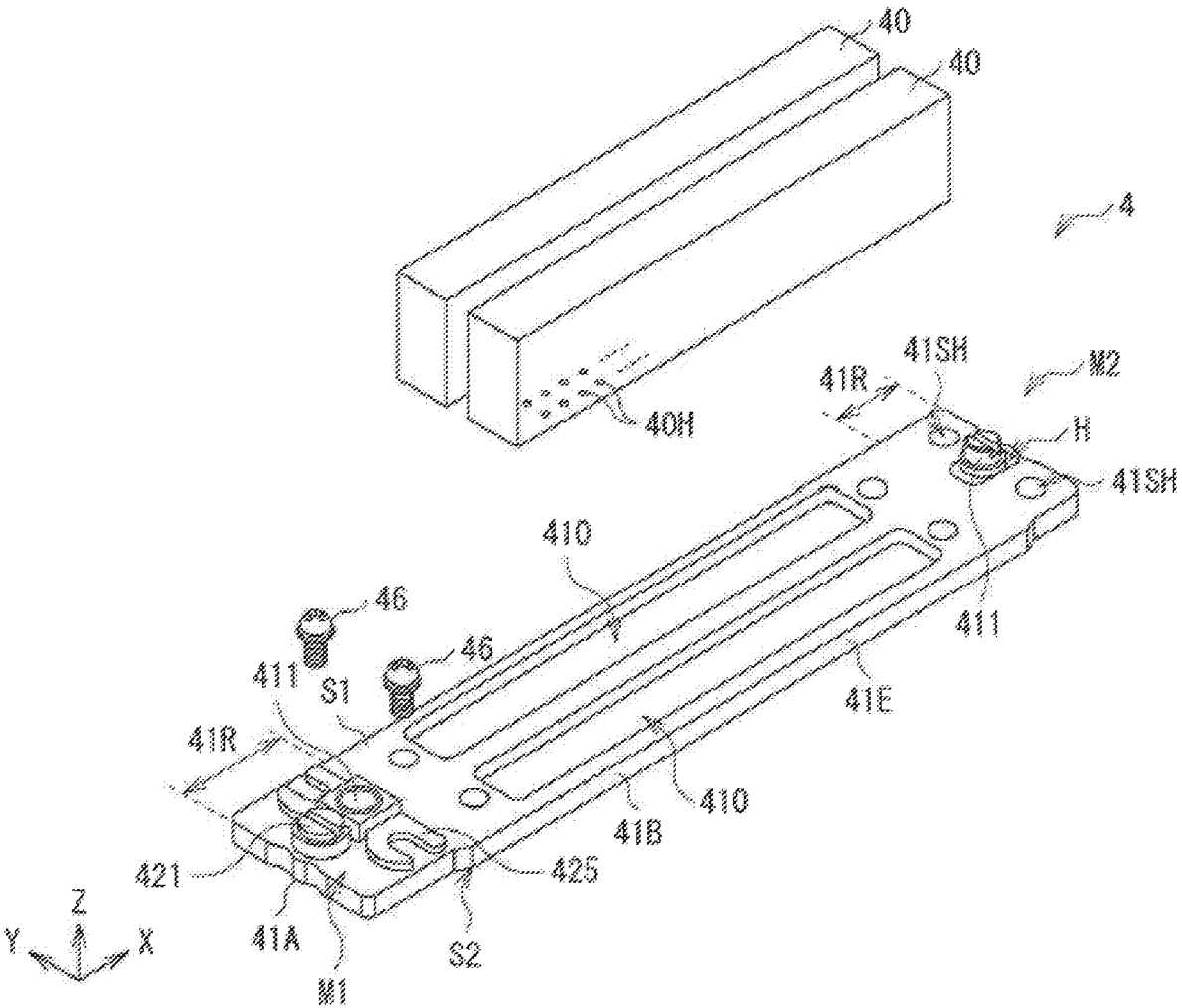
FIG. 5 is an exploded perspective view of the ink jet head shown in FIG. 4.

The details of the configuration of the inkjet heads 4 will be described with reference to FIG. 4 and FIG. 5 in addition to FIG. 2 and FIG. 3. FIG. 4 and FIG. 5 show the configuration of the inkjet head 4 with a plan view and an exploded perspective view, respectively. In FIG. 5, the illustration of a cover 42 is omitted for the sake of convenience of explanation.

The inkjet head 4 is typically provided with head modules 40, a base plate 41, position adjustment mechanisms M, and the cover 42, wherein the head modules 40 each have a plurality of jet holes 40H, the base plate 41 intervenes between the carriage 33 and the head modules 40 to support the head modules 40, the position adjustment mechanisms M adjust the positions of the jet holes 40H with respect to the carriage 33, and the cover 42 covers the head modules 40. The head modules 40 are each a specific example of a "nozzle section" related to the present disclosure, and the base plate 41 is a specific example of a "support member" related to the present disclosure.

(Head Modules 40)

Figure 6:
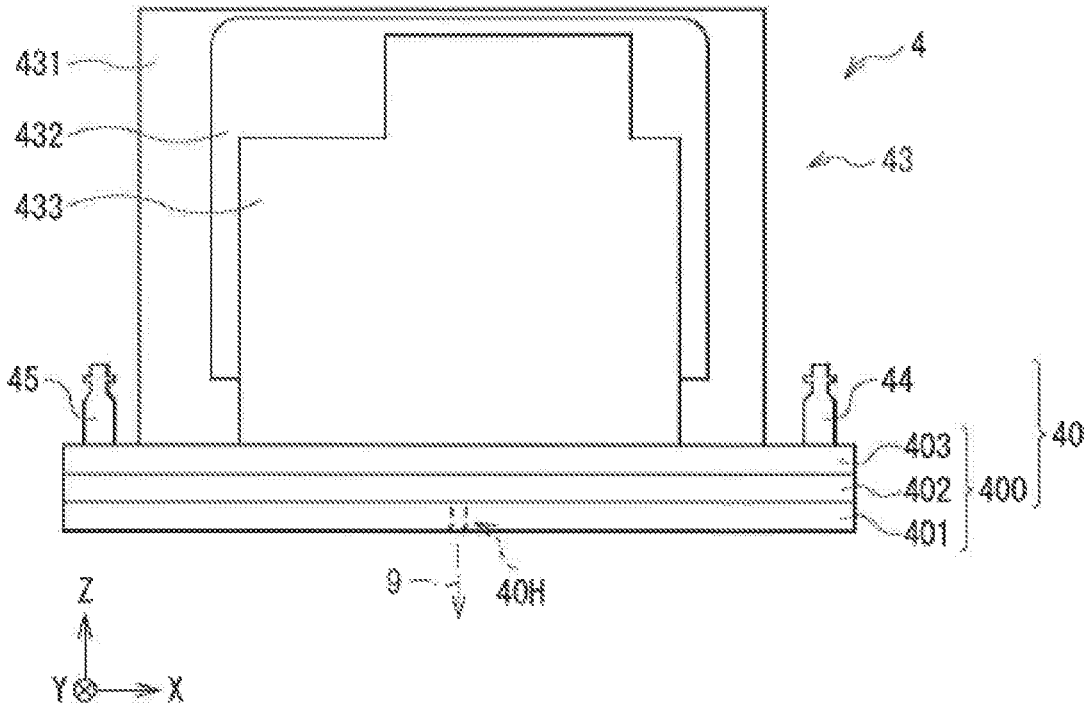
FIG. 6 is an elevation view schematically showing an internal structure of the inkjet head shown in FIG. 4.

FIG. 6 schematically shows an internal structure of the inkjet head 4 with a cross-sectional elevation view with the X-Z plane. In the present embodiment, the inkjet head 4 is provided with an electronic control board 43 in addition to the head modules 40. The head modules 40 are each provided with a head chip 400, and at the same time, provided with an introduction port 44 and a discharge port 45 to form a flow channel of the ink from the introduction port 44 toward the discharge port 45, and the jet holes 40H are disposed so as to branch from the flow channel. FIG. 6 shows a droplet 9 of the ink ejected from the jet hole 40H.

The head chip 400 jets the ink received via the introduction port 44 toward the recording paper P from the jet hole 40H to thereby make the ink (the droplet 9) adhere to the recording paper. The head chip 400 is provided with a nozzle plate 401, an actuator plate 402, and a cover plate 403 stacked in sequence from, for example, a side far from the electronic control board 43, namely a side close to the recording paper P not shown.

The nozzle plate 401 has a plurality of communication holes forming the jet holes 40H. In the present embodiment, the plurality of communication holes is arranged side by side in the X direction. Thus, the nozzle plate 401 has a nozzle array extending in the X direction (FIG. 5). It should be noted that in FIG. 6, the illustration is simplified for the sake of convenience of explanation, and just one of the communication holes (i.e., the jet holes 40H) is shown. In the state in which the head modules 40 are attached to the base plate 41 (FIG. 4), the surface having the jet holes 40H of each of the head modules 40 is exposed on the reverse surface S2 side or the lower side of the base plate 41, and the head modules 40 jet the ink in a Z direction.

The actuator plate 402 has a plurality of jet channels respectively communicated with the jet holes 40H, and electrically changes the pressure in the jet channel in which the ink 9 is introduced to thereby push the ink in the jet channel out toward the jet hole 40H, and thus, jet the ink outside from the jet hole 40H when performing recording (printing) on the recording paper P.

The cover plate 403 has a plurality of slits, and introduces the ink 9 into the actuator plate 402 (specifically the jet channel) via the plurality of slits.

(Base Plate 41)

The base plate 41 is fixed to the carriage 33 to support the head modules 40. In the present embodiment, the base plate 41 is formed of a plate-like member having a roughly rectangular shape, and forms a flat plate-like shape as a whole. The base plate 41 further includes positioning areas 41R in which the position adjustment mechanisms are implemented in both end portions in a long-side direction (the X direction in FIG. 5).

The base plate 41 shaped like a flat plate has an obverse surface S1, and a reverse surface S2 facing opposite to the obverse surface S1, wherein the cover 42 is attached to the obverse surface S1. A thickness direction of the base plate 41 (the Z direction in FIG. 5) coincides with a jet direction of the ink from the jet holes 40H. The base plate 41 has an outer circumferential edge 41E having a rectangular shape and surrounding four sides of the obverse surface S1 and the reverse surface S2. In the present embodiment, on one of a pair of short sides (the sides extending in the Y direction) constituting the outer circumferential edge 41E of the base plate 41, there is disposed a first stopper 41A protruding toward the X direction from the outer circumferential edge 41E surrounding the first stopper 41A. On the other hand, on one of a pair of long sides (the sides extending in the X direction) constituting the outer circumferential edge 41E of the base plate 41, there is disposed a second stopper 41B protruding toward the Y direction from the outer circumferential edge 41E surrounding the second stopper 41B. The stoppers 41A, 41B are each struck against a predetermined place in the interior walls of a base plate insertion hole provided to the carriage 33 when attaching the inkjet head 4 to the carriage 33. Thus, a rough position of the base plate 41 (i.e., the jet holes 40H) with respect to the carriage 33 is fixed.

In a central part of the base plate 41, there are disposed insertion holes 410 to which the head modules 40 are respectively inserted. The insertion holes 410 penetrate the base plate 41 in the thickness direction, and each have a shape coinciding with the outer shape of the head module 40 in a plan view of the base plate 41 viewed in an insertion direction of the head module 40 (the Z direction in FIG. 5). Long sides of the insertion hole 410 are disposed roughly in parallel to the long side of the outer circumferential edge 41E, and short sides of the insertion hole 410 are formed roughly in parallel to the short side of the outer circumferential edge 41E. In the present embodiment, two insertion holes 410 are disposed side by side in the Y direction, and thus, it is possible to install two head modules 40 in every base plate 41.

The base plate 41 has the positioning areas 41R in the both end portions in a long-side direction (the X direction). The positioning areas 41R are each an area where the position adjustment mechanism M described later is installed, and the position adjustment mechanism M adjusts the relative position of the base plate 41 with respect to the carriage 33 to thereby indirectly adjust the positions of the jet holes 40H or the nozzle array with respect to the carriage 33. In the present embodiment, the positioning areas 41R are each disposed outside the head modules 40 and the cover 42, specifically, outside in the long-side direction or the X direction in the plan view shown in FIG. 4.

(Electronic Control Board 43)

The electronic control board 43 controls the overall operation of the inkjet head 4. In the present embodiment, the electronic control board 43 is provided with a circuit board 431, a drive circuit 432, and a flexible board 433. The circuit board 431 is elected on the head chip 400, and the drive circuit 432 includes an electronic component such as an integrated circuit (IC), and is provided to the circuit board 431. The flexible board 433 is coupled to the head chip 400 and the drive circuit 432.

(Cover 42)

The cover 42 is disposed on the base plate 41 (specifically, the obverse surface S1) so as to surround the electronic control board 43 to prevent the adhesion of the ink 9 to the electronic control board 43. In the present embodiment, the cover 42 has a rectangular solid box-like shape, and the long sides of the cover 42 are disposed along the long-side direction (the X direction) of the base plate 41.

[Detailed Configuration of Position Adjustment Mechanism M1]

Figure 7:
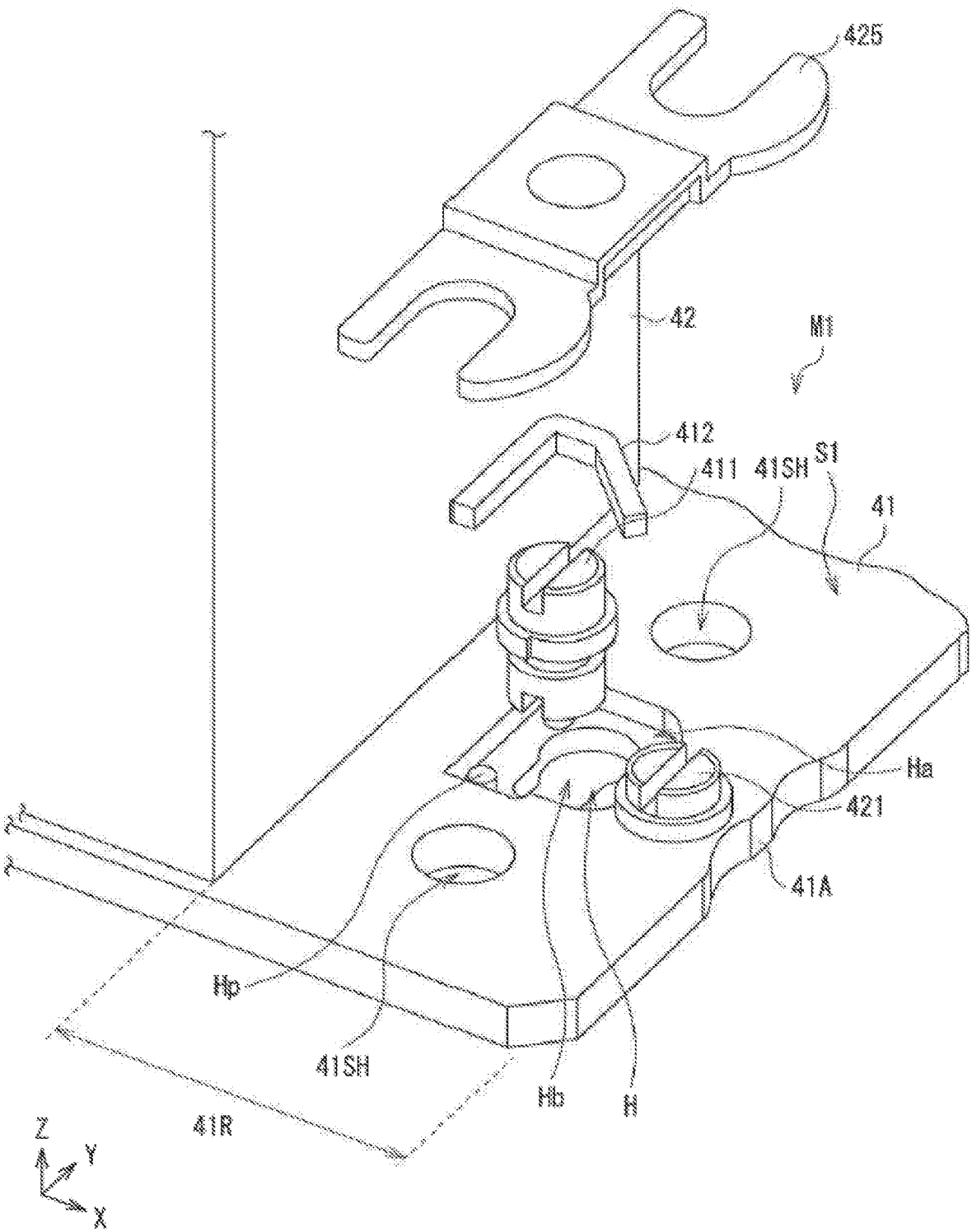
FIG. 7 is an exploded perspective view schematically showing a configuration of a position adjustment mechanism provided to the inkjet head shown in FIG. 4.
Figure 8:
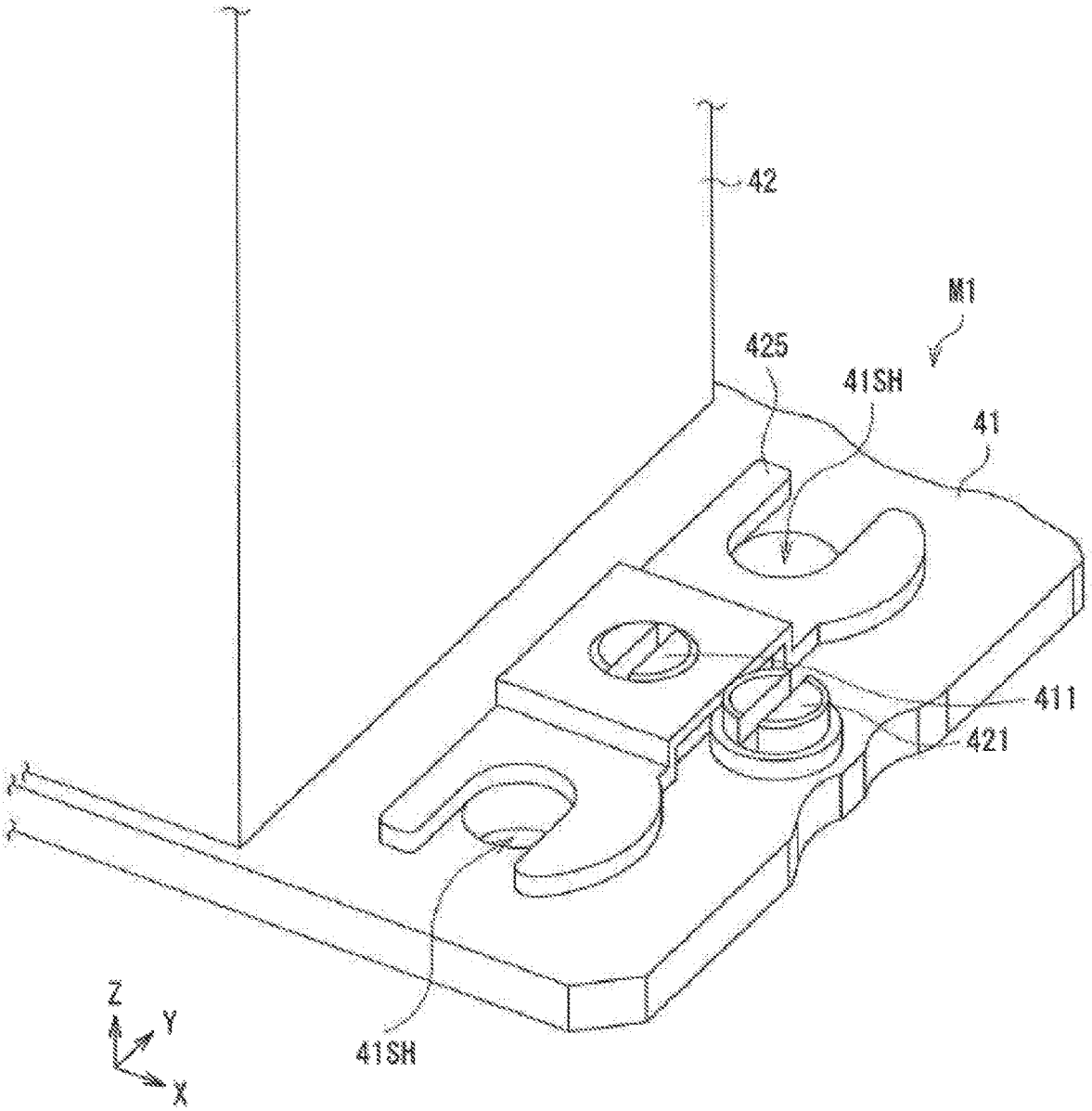
FIG. 8 is a perspective view showing an appearance of the position adjustment mechanism obtained by assembling the position adjustment mechanism shown in FIG. 7.

FIG. 7 schematically shows the configuration of the position adjustment mechanism M1 related to the present embodiment with an exploded perspective view, and FIG. 8 schematically shows the appearance of the position adjustment mechanism M1 having been assembled with a perspective view. In the present embodiment, the positions of the jet holes 40H with respect to the carriage 33 are adjusted using the position adjustment mechanism M1. As the directions in which the positioning is performed, there are determined a rotational direction (a 0 direction) and a translation direction (the X direction), and as devices for achieving the positioning in the respective directions, there are provided an adjustment mechanism in the θ direction (hereinafter referred to as a "θ-adjustment section"), and an adjustment mechanism in the X direction (hereinafter referred to as an "X-adjustment section"). It should be noted that the θ-adjustment section can also be operated as an adjustment mechanism in the Y direction depending on the method of the operation. Further, in the present embodiment, the configuration is different between position adjustment mechanisms M1, M2 provided to the both ends. Specifically, as shown in FIG. 4, the position adjustment mechanism M1 provided on one side (the right side in FIG. 4) is provided with both of the θ-adjustment section and the X-adjustment section, and the position adjustment mechanism M2 provided on the other side (the left side in FIG. 4) is provided with the θ-adjustment section alone out of the θ-adjustment section and the X-adjustment section. The θ-adjustment sections respectively provided to the position adjustment mechanisms M1, M2 are the same in configuration.

(δ-Adjustment Section)

The θ-adjustment section is generally constituted by a carriage pin 411 and a spring 412. The carriage pin 411 is a specific example of a "reference member" related to the present disclosure, and is a position adjustment member for the θ adjustment, and at the same time, also functions as the reference member for the X adjustment in the present embodiment. The spring 412 is a specific example of a "biasing member" related to the present disclosure, and is constituted by a wire spring in the present embodiment. In each of the positioning areas 41R, there are disposed a hole part H penetrating the base plate 41 in the thickness direction and screw holes 41SH, and the carriage pin 411 and the spring 412 are fitted into the hole part H.

Figure 9:
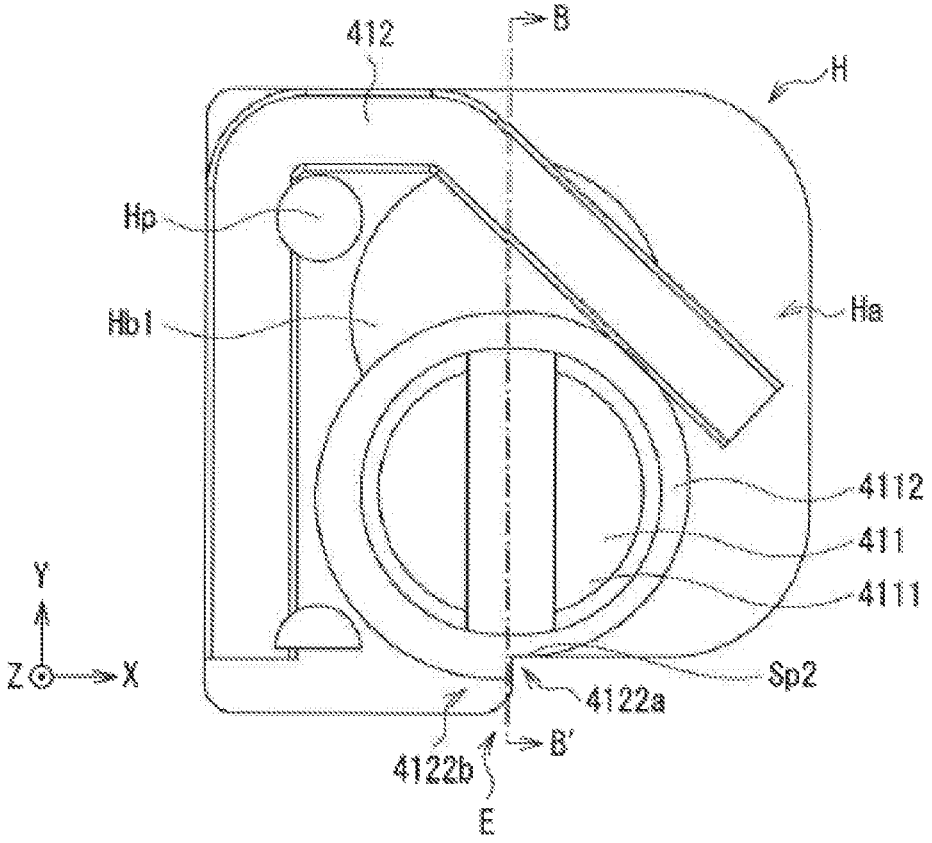
FIG. 9 is an enlarged plan view of a θ adjustment section of the position adjustment mechanism shown in FIG. 7.

FIG. 9 is an enlarged plan view of the θ-adjustment section, and shows the carriage pin 411 and the spring 412 in the state of being fitted into the hole part H.

The hole part H has a bottomed hole Ha opening on the obverse surface S1 side of the base plate 41, and a through hole Hb penetrating the base plate 41 in the thickness direction. A seating surface 41Z of the bottomed hole Ha is disposed between the obverse surface S1 and the reverse surface S2 of the base plate 41, namely in the middle in the thickness direction of the base plate 41. On the seating surface 41Z, there are disposed protruding parts Hp protruding toward the obverse surface S. The bottomed hole Ha and the through hole Hb are communicated with each other to form an integrated space opening on the obverse surface S1 side.

The screw holes 41SH each penetrate the base plate 41 in the thickness direction, and screws 46 (FIG. 5) are respectively inserted in the screw holes 41SH. The screws 46 are inserted into threaded holes provided to the carriage 33 through the screw holes 41SH, respectively, to clamp a sleeve 414 of the X-adjustment section described later together with the base plate 41. In other words, with the screws 46, the base plate 41 is fixed to the carriage 33, and at the same time, the sleeve 414 is also fixed thereto.

Figure 10:
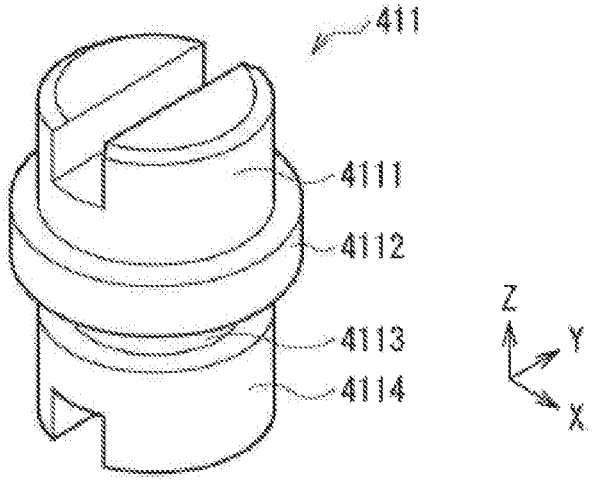
FIG. 10 is a perspective view of an adjustment pin (a θ-adjustment pin) provided to the θ-adjustment section shown in FIG. 9.

FIG. 10 is a perspective view of the carriage pin 411. As described above, the carriage pin 411 is the position adjustment member for the θ adjustment for performing the position adjustment in the θ direction, and at the same time, also functions as the reference member for the X adjustment. In the present embodiment, the carriage pin 411 is fitted into the inside of the outer circumferential edge 41E of the base plate 41, specifically the hole part H, together with the spring 412.

In the present embodiment, the carriage pin 411 has a shaft part 4111, an eccentric part 4112, an intermediate part 4113, and a shaft part 4114 in this order along the central axis from the upper side toward the lower side in FIG. 10. The eccentric part 4112 has an outer circumferential surface or a cam face eccentric with respect to the central axis of the carriage pin 411. The eccentric part 4112 and the intermediate part 4113 smaller in diameter than the eccentric part 4112 fit in the hole part H, and are housed within a thickness range of the base plate 41. It is possible to attach the carriage pin 411 to the base plate 41 from the reverse surface of the carriage 33 via the through hole Hb. In the state in which the carriage pin 411 is fitted into the hole part H, the shaft part 4111 protrudes from the hole part H toward the obverse surface S1, namely in the Z direction. As described later, the shaft part 4111 makes a contribution to the position adjustment in the X direction of the jet holes 40H in cooperation with the adjustment pin (e.g., an eccentric pin 421) of the X-adjustment section.

On the other hand, the shaft part 4114 is inserted into a shaft hole of the carriage 33. In the present embodiment, the cross-sectional surface of the shaft part 4114 perpendicular to the central axis of the carriage 33 has a circular shape, and the shaft part 4114 can rotate around the central axis of the carriage pin 411 in the state of being inserted in the shaft hole. In other words, the carriage pin 411 is rotatably pivoted by the shaft hole of the carriage 33. Thus, the position in the X and Y directions, namely planar directions, of the carriage pin 411 with respect to the carriage 33 is fixed.

Figure 11:
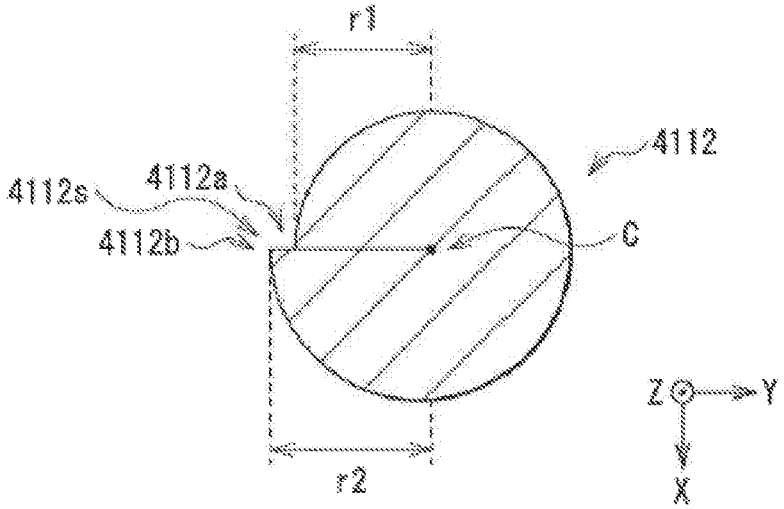
FIG. 11 is a cross-sectional view of an eccentric part of the θ-adjustment pin shown in FIG. 10.

FIG. 11 is a cross-sectional view of the eccentric part 4112 along a plane perpendicular to a central axis C of the carriage pin 411. In the present embodiment, in the eccentric part 4112, the outer circumferential surface is formed as a cam face, and the outer circumferential surface is provided with a stepped part 4112*s* where the distance from the central axis of the rotation, namely the central axis C of the carriage pin 411, changes discontinuously. In other words, the eccentric part 4112 has a rotation initial part 4112*a* in which the distance from the central axis C to the outer circumference is the shortest distance r1, and a rotation terminal part 4112*b* in which the distance from the central axis C to the outer circumference is a distance r2 longer than the distance r1, and the distance from the central axis C monotonically increases from the rotation initial part 4112*a* toward the rotation terminal part 4112*b*. As a part where the radius is made to change discontinuously, the stepped part 4112*s* is formed between the rotation initial part 4112*a* and the rotation terminal part 4112*b* adjacent thereto.

The spring 412 is disposed in the bottomed hole Ha of the hole part H (FIG. 9). The spring 412 intervenes between the carriage pin 411 and the base plate 41 to bias the base plate 41 toward the carriage 33 via the carriage pin 411. By being biased by the spring 412, a rough position in the 0 direction of the base plate 41, namely the jet holes 40H, with respect to the carriage 33 is fixed. Further, it is possible to prevent a backlash from occurring in the base plate 41 when rotating the carriage pin 411 for the θ adjustment.

The spring 412 is clipped between the protruding parts Hp and the interior wall of the bottomed hole Ha, and the position in the bottomed hole Ha is fixed by the protruding parts Hp. The spring 412 has a bend part, and a tip part from the bend part protrudes toward the inside of the hole part H to have contact with the eccentric part 4112 (specifically, the outer circumferential surface) of the carriage pin 411. The eccentric part 4112 is in a state in which the rotation initial part 4112*a* has contact with a second pressure-receiving surface Sp2 of the base plate 41 formed as a part of the interior wall of the hole part H, and is pressed against the second pressure-receiving surface Sp2 by the spring 412. The reactive force reaches the base plate 41 via the spring 412 to bias the base plate 41.

Figure 12:
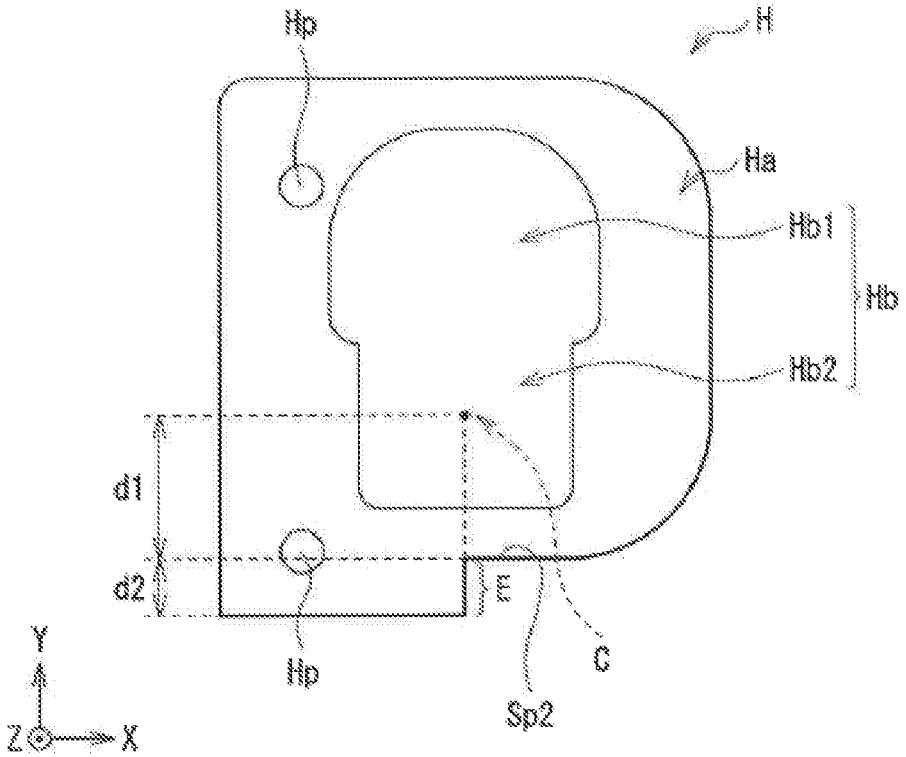
FIG. 12 is a plan view of a hole part of a base plate for housing the θ-adjustment section shown in FIG. 9.

FIG. 12 is a plan view of the hole part H of the base plate 41. As described above, the hole part H has the bottomed hole Ha and the through hole Hb, the bottomed hole Ha has, for example, a quadrangular planer shape, and the through hole Hb has a keyhole-like planar shape constituted by a large-diameter part Hb1 and a small-diameter part Hb2. The dimension of the small-diameter part Hb2 coincides with the outside diameter of the intermediate part 4113 of the carriage pin 411. In the plan view in the Z direction shown in FIG. 12, the bottomed hole Ha is larger than the through hole Hb to create the state in which the outer circumferential edge of the through hole Hb exists inside the outer circumferential edge of the bottomed hole Ha. Further, the second pressure-receiving surface Sp2 which the eccentric part 4112 of the carriage pin 411 has contact with is disposed in a part of the interior wall forming the outer circumferential edge of the bottomed hole Ha.

In the present embodiment, the second pressure-receiving surface Sp2 is located at a position with a distance dl from the position of the central axis C of the carriage pin 411. The distance dl is the same as the distance r1 from the central axis C of the rotation initial part 4112*a* of the eccentric part 4112. Therefore, by disposing the carriage pin 411, and rotating the carriage pin 411 (clockwise shown in FIG. 9) from the state in which the rotation initial part 4112*a* is made to have contact with the second pressure-receiving surface Sp2, the distance from the central axis C to the second pressure-receiving surface Sp2 increases. Thus, the displacement in the Y direction of the base plate with respect to the carriage 33 can be obtained.

(X-Adjustment Section)

Figure 13:
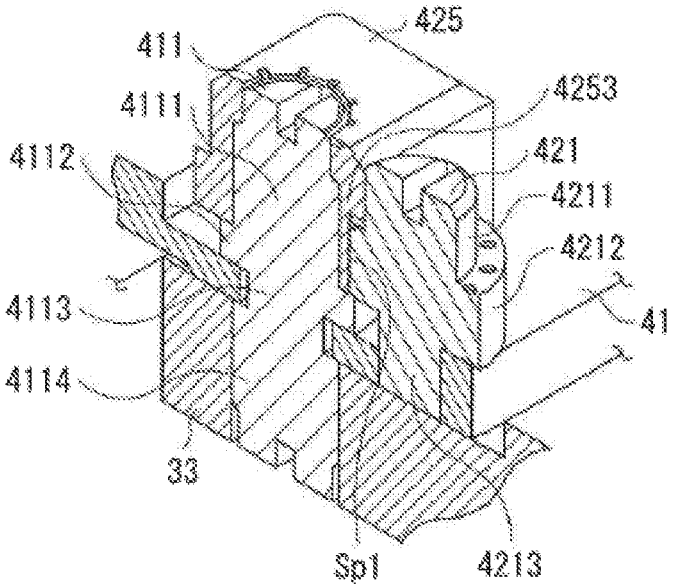
FIG. 13 is a cross-sectional perspective view of an X-adjustment section of the position adjustment mechanism shown in FIG. 7.

FIG. 13 is a cross-sectional perspective view of the X-adjustment section. The X-adjustment section of the position adjustment mechanism M1 related to the present embodiment will be described in detail with reference to FIG. 13.

The X-adjustment section is provided with the carriage pin 411, the eccentric pin 421, and a sleeve (in the present embodiment, the sleeve is a member overlaid on, or fitted into, the pin, and can therefore be also referred to as a "socket") 425. As described above, the carriage pin 411 is a specific example of the "reference member" related to the present disclosure, and in the present embodiment, the shaft part 4114 on the lower side is inserted into the shaft hole of the carriage 33. In the state in which the shaft part 4114 is inserted into the shaft hole of the carriage 33, the carriage pin 411 can be rotated around the central axis C of the carriage pin 411 with respect to the carriage 33, and at the same time, the position in X-Y directions, namely the position in planar direction, with respect to the carriage 33 is fixed. The eccentric pin 421 is a specific example of the "position adjustment member" related to the present disclosure, and is rotatably coupled to the base plate 41. The sleeve 425 is a specific example of an "intermediary member" related to the present disclosure, and is disposed between the carriage pin 411 and the eccentric pin 421 as an intermediate. In the present embodiment, the eccentric pin 421 is provided with an eccentric part 4212 having an outer circumferential surface eccentric with respect to the central axis of the rotation, the eccentric action exerted by the outer circumferential surface of the eccentric part 4212 is transmitted to the carriage pin 411 (specifically, the shaft part 4111 in the upper part thereof) via the sleeve 425, and the base plate 41 is moved on the carriage 33 due to the reactive force.

(Eccentric Pin 421)

As shown in FIG. 13, the eccentric pin 421 has shaft parts 4211, 4213 on the upper and lower sides, respectively, and has the eccentric part 4212 between these shaft parts 4211, 4213. The shaft parts 4211, 4213 are concentrically formed, and the eccentric part 4212 has an outer circumferential surface eccentric with respect to the central axis of the shaft parts 4211, 4213. The central axis of the shaft parts 4211, 4213 becomes the central axis of the whole of the eccentric pin 421, and is parallel to the central axis of the carriage pin 411 in the present embodiment. Further, in the present embodiment, the shaft part 4213 on the lower side is smaller in diameter than the shaft part 4211 on the upper side, and is inserted into the shaft hole of the base plate 41. The eccentric part 4212 is larger in diameter than the shaft part 4211 on the upper side. In the state in which the shaft part 4213 is inserted in the shaft hole of the base plate 41, at least the shaft part 4213 (preferably the whole of the eccentric pin 421 including the eccentric part 4212) of the eccentric pin 421 is located on the inner side of the outer circumferential edge 41E of the base plate 41, and it is possible for the eccentric pin 421 to rotate around the central axis with respect to the base plate 41.

(Sleeve 425)

Figure 14:
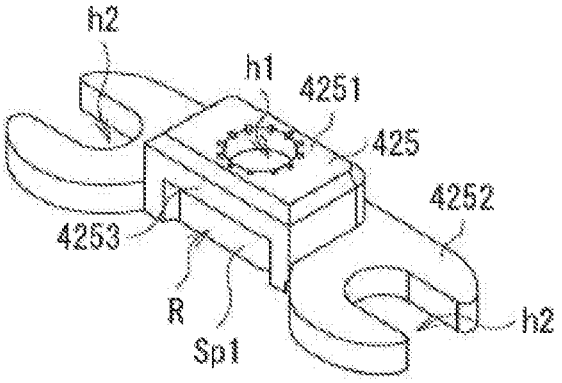
FIG. 14 is a perspective view of a sleeve provided to the X-adjustment section shown in FIG. 13.

FIG. 14 is a perspective view of the sleeve 425, and shows an appearance of the whole of the sleeve 425. In the present embodiment, the sleeve 425 is attached to the carriage pin 411. Specifically, the sleeve 425 is generally constituted by a main body part 4251, and flared parts 4252 flaring on both sides of the main body part 4251. The sleeve 425 is provided with a through hole h1 vertically penetrating the main body part 4251, and by inserting the shaft part 4111 on the upper side of the carriage pin 411 into the through hole h1, the sleeve 425 is attached to the carriage 411. The cross-sectional shape of the through hole h1 coincides with the cross-sectional shape of the shaft part 4111 to be received by the through hole h1, and thus, the shaft part 4111 intimately fits in the through hole h1 without a backlash. Those penetrating the flared parts 4252 on both sides in the same direction as that of the through hole h1 are screw holes h2 through which screws for clamping the sleeve 425 to the carriage 33 together with the base plate 41 are inserted.

In the present embodiment, on a side surface of the main body part 4251 of the sleeve 425, there is formed a first pressure-receiving surface Sp1 disposed in parallel to the central axis of the through hole h, namely the central axis of the carriage pin 411. In the state in which the sleeve 425 is attached to the carriage pin 411, the first pressure-receiving surface Sp1 faces to a displacement direction of the base plate 41 and the jet holes 40H due to the X adjustment, and in other words, the normal line of the first pressure-receiving surface Sp1 is parallel to the displacement direction of the base plate 41. As shown in FIG. 13, the eccentric part 4212 (specifically the outer circumferential surface thereof) of the eccentric pin 421 is made to touch the first pressure-receiving surface Sp1. By rotating the eccentric pin 421 around the central axis thereof in this state, it is possible to exert the action of the eccentric part 4212 on the sleeve 425 to transmit the action to the carriage pin 411 via the sleeve 425. In the present embodiment, the first pressure-receiving surface Sp1 and the second pressure-receiving surface Sp2 described above are made to face to the respective directions perpendicular to each other. Specifically, the direction of the first pressure-receiving surface Sp1 is parallel to a nozzle array direction as the displacement direction of the base plate 41, and the direction of the second pressure-receiving surface Sp2 is perpendicular to the nozzle array direction.

Further, in the present embodiment, there is further provided a locking part 4253 for locking the eccentric part 4212 of the eccentric pin 421 to the main body part 4251 of the sleeve 425 from the distal side from the base plate 41. Thus, the eccentric part 4212 is set in the state of being vertically sandwiched by the locking part 4253 and the obverse surface S1 of the base plate 41. In other words, in the sleeve 425, a recessed part R in which a part of the eccentric part 4212 is inserted is disposed on a side surface of the main body part 4251, and the first pressure-receiving surface Sp1 is formed on the recessed part R to which the outer circumferential surface of the eccentric part 4212 faces.

Figure 15:
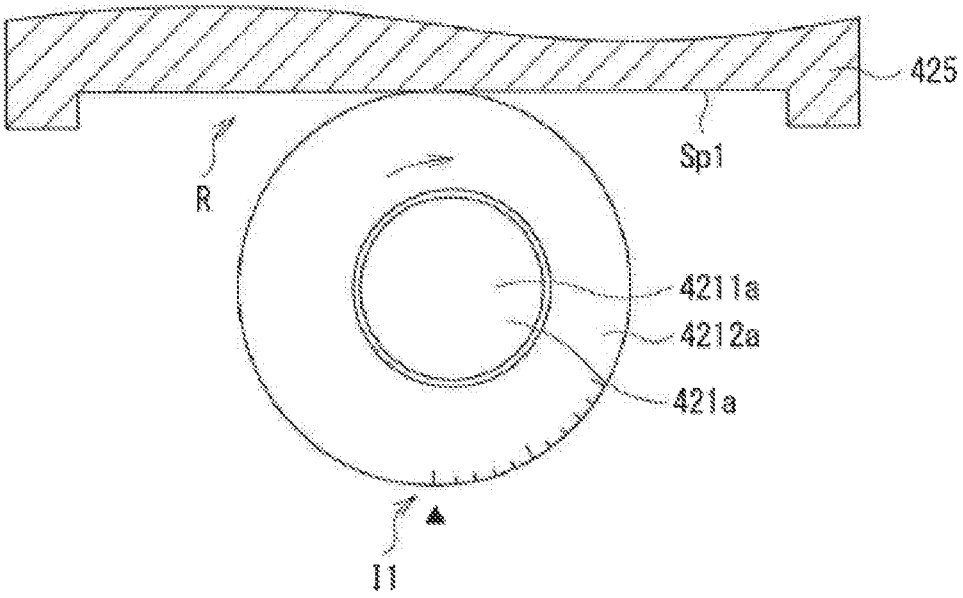
FIG. 15 is an enlarged plan view showing a relationship between an eccentric surface of an adjustment pin (an X-adjustment pin) and a pressure-receiving surface of the sleeve provided to the X-adjustment section shown in FIG. 13.
Figure 20:
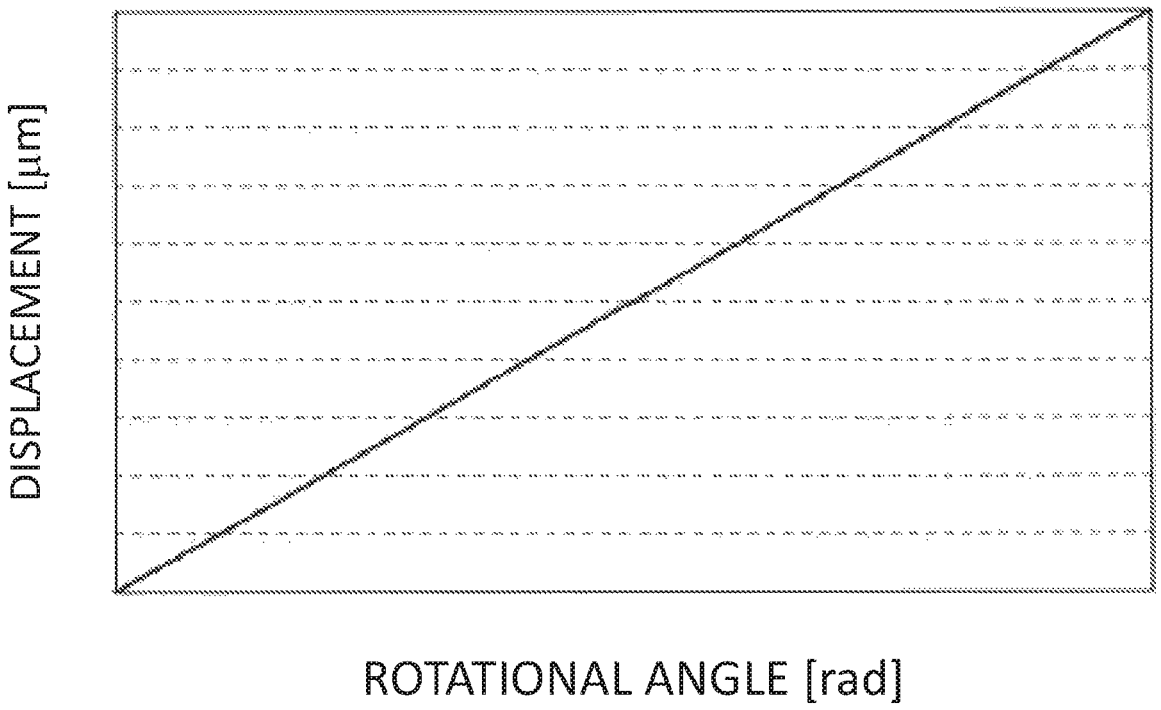
FIG. 20 is an explanatory diagram showing a relationship between a rotational angle of the X-adjustment pin shown in FIG. 15 and a displacement in the X direction provided to a nozzle array.

FIG. 15 shows a relationship between the eccentric part 4212 (4212*a*) of the eccentric pin 421 and the first pressure-receiving surface Sp1 of the sleeve 425 with an enlarged cross-sectional view. A part close to the outer circumferential edge of the eccentric part 4212*a* is inserted in the recessed part R of the main body of the sleeve 425, and the outer circumferential surface of the eccentric part 4212*a* has contact with the bottom surface of the recessed part R, namely the first pressure-receiving surface Sp1 of the sleeve 425. Here, between the rotational angle of the eccentric part 4212*a* and the displacement of the base plate 41 due to the function of the eccentricity, there is a relationship corresponding to the amount of the eccentricity of the eccentric part 4212*a* with respect to the central axis of the eccentric pin 421. FIG. 20 shows an example of such a relationship. For example, by providing a display section for displaying a rotational angle of the eccentric part 4212*a*, it is possible to figure out an actual displacement of the base plate 41 and the nozzle array toward the displacement direction (the X direction in the present embodiment) of the base plate 41. As such a display section, a display section I1 shaped like a dial is illustrated in FIG. 15.

Figure 16:
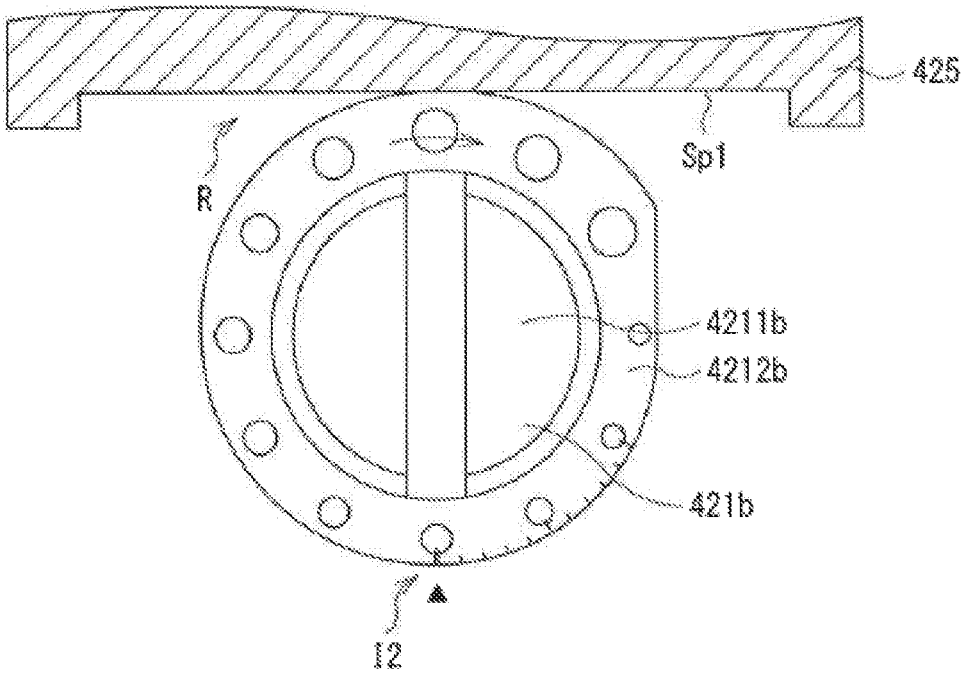
FIG. 16 is an enlarged plan view showing a relationship between a cam surface of the X-adjustment pin and the pressure-receiving surface of the sleeve of a position adjustment mechanism related to a modified example of the embodiment.

The position adjustment in the X direction can be realized not only by the function of the eccentricity (due to, e.g., the eccentric pin 421 (421*a*)), but also by a function of a cam. FIG. 16 shows an example in which a different configuration from that in the example shown in FIG. 13 or FIG. 15 is adopted in the X-adjustment section as the position adjustment mechanism M1 related to a modified example of the present embodiment. In the modified example, a cam pin 421*b* is adopted as the adjustment pin in the X direction instead of the eccentric pin, and a cam part 4212*b* provided to the cam pin 421*b* is adopted instead of the eccentric part. FIG. 16 shows a relationship between an outer circumferential surface (a cam face) of the cam part 4212*b* and the first pressure-receiving surface Sp1 of the sleeve 425 related to the modified example with an enlarged cross-sectional view similar to FIG. 15. When using the cam part 4212*b*, it is possible to monotonically increase or decrease the height of the cam, which is the distance from the central axis of the rotation of the cam pin 421*b* to the can face, throughout a roughly whole circumference in the rotational direction. Therefore, it is possible to suppress the displacement per unit rotational angle necessary to achieve a predetermined displacement to a small amount compared to the example described above using the function of the eccentricity to thereby make a contribution to the realization of more precise positioning.

[Method of Installing Inkjet Heads 4]

Figure 17:
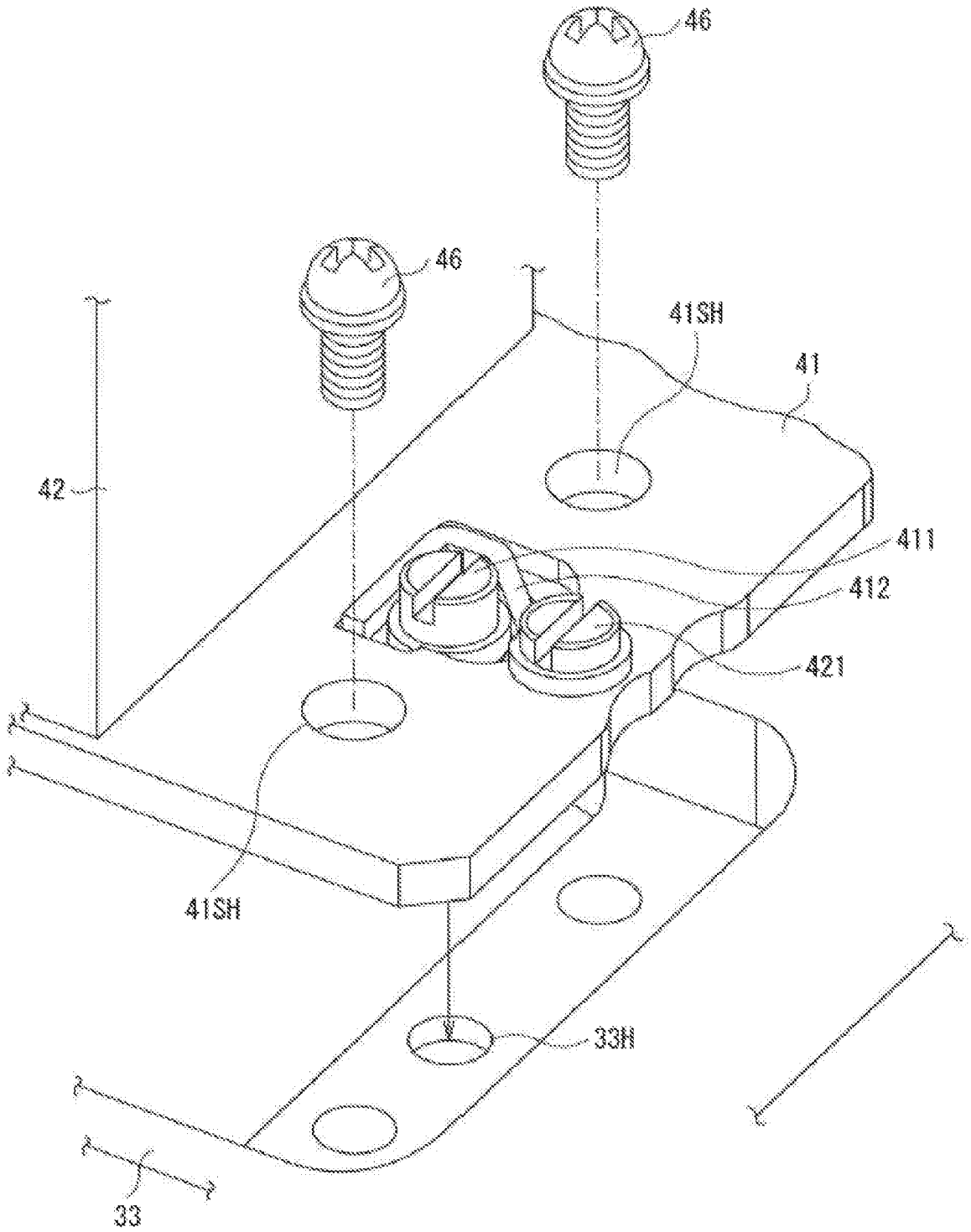
FIG. 17 is a perspective view showing a method of attaching the inkjet head shown in FIG. 2 to the carriage.

FIG. 17 shows a method of installing the inkjet head according to the present embodiment to the carriage with a perspective view of the positioning area 41R. In FIG. 17, the illustration of the sleeve 425 is omitted for the sake of convenience of explanation. As already described, the sleeve 425 is overlaid on the carriage pin 411 from above, and is clamped to the carriage 33 together with the base plate 41 with the screws 46.

Firstly, the carriage pin 411 and the spring 412 are fitted into the hole part H of the base plate 41 in this order. The shaft part 4111 and the eccentric part 4112 of the carriage pin 411 are inserted into the large-diameter part Hb1 of the through hole Hb from below, and then the carriage pin 411 is moved in the through hole Hb so that the intermediate part 4113 is fitted in the small-diameter part Hb2 of the through hole Hb (FIG. 12). The spring 412 is mounted on the seating surface of the bottomed hole Ha, and is then fitted between the protruding parts Hp and the interior wall of the bottomed hole Ha as shown in FIG. 9.

Subsequently, the shaft part 4114 of the carriage pin 411 protruding from the reverse surface S2 of the base plate 41 is inserted into a shaft hole 33H of the carriage 33. Thus, the carriage pin 411 is pivotally supported by the shaft hole 33H of the carriage 33.

Further, when mounting the base plate 41 on the carriage 33, the spring 412 having contact with the carriage pin 411 (specifically the eccentric part 4112) biases the carriage pin 411 pivotally supported by the shaft hole 33H of the carriage 33. The base plate 41 is biased by the reactive force, and the stoppers 41A, 41B of the base plate 41 are struck against predetermined regions of the carriage 33, and thus, the rough position in the X-Y plane of the base plate 41, namely the jet holes 40H, with respect to the carriage 33 is fixed. Here, on the second pressure-receiving surface Sp2 disposed on the interior wall of the bottomed hole Ha, there is disposed the rotation initial part 4112*a* out of the eccentric part 4112 of the carriage pin 411.

Figure 18:
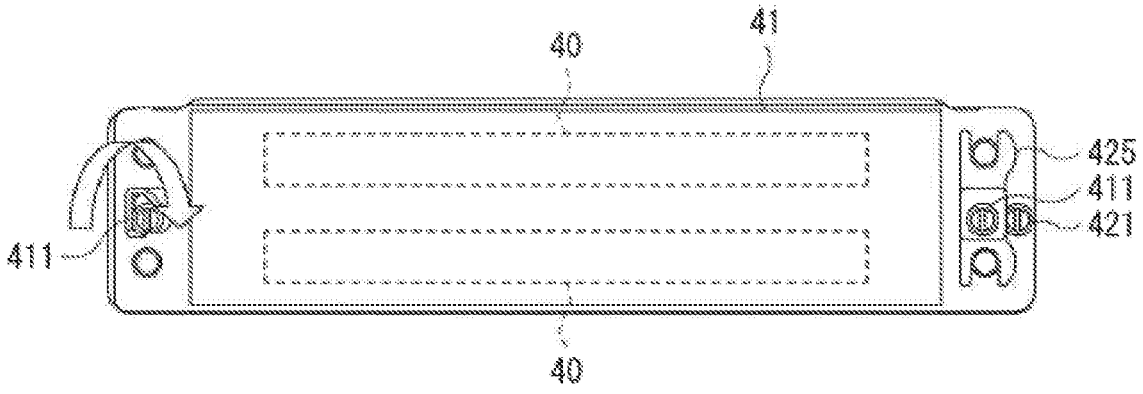
FIG. 18 is an operation explanation diagram showing an adjusting method in a θ-direction by the θ-adjustment section shown in FIG. 9.

Subsequently, by rotating the carriage pin 411 as shown in FIG. 18, the positions in the rotational direction (i.e., the θ direction) in the X-Y plane of the jet holes 40H are adjusted. The relationship between the direction in which the carriage pin 411 is rotated and the displacement direction of the jet holes 40H generated by the rotation of the carriage pin 411 depends on the design of the eccentric surface or the cam face. Due to the rotation of the carriage pin 411, the longer the distance of the eccentric surface pushing the second pressure-receiving surface Sp2 from the central axis C of the carriage pin 411 becomes, the more the distance between the central axis C and the second pressure-receiving surface Sp2 is increased, and thus, the base plate 41 is displaced. In the present embodiment, the clockwise rotation is allowed on the sheet of FIG. 9 on the one hand, but the counterclockwise rotation opposite thereto is restricted on the other hand since the stepped part 4112*s* of the carriage pin 411 is struck against a catching part E of the interior wall of the hole part H. Thus, the rotation in the wrong direction by the user is prevented. Here, when rotating the carriage pin 411 in one of the positioning areas 41R, a rotation around the carriage pin 411 in the other of the positioning areas 41R occurs in the base plate 41. By arbitrarily rotating the carriage pin 411 disposed in the positioning area 41R on each side in such a manner, it is possible to adjust the positions in the rotational direction of the base plate 41 and the jet holes 40H.

After or in parallel to the position adjustment (the θ-adjustment) in the rotational direction, the position adjustment in a translational direction (the X direction in the present embodiment) is performed.

Figure 19:
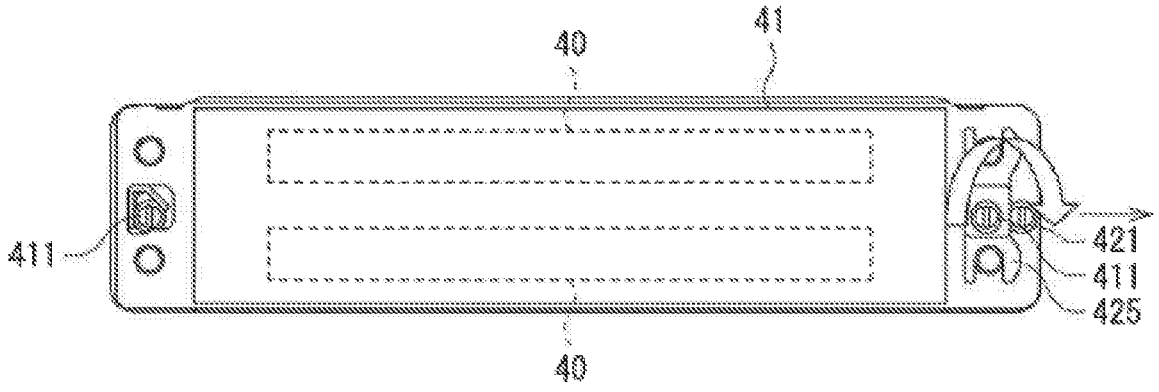
FIG. 19 is an operation explanation diagram showing an adjusting method in an X-direction by the X-adjustment section shown in FIG. 13.

As shown in FIG. 19, by rotating the eccentric pin 421, the positions in the X direction of the jet holes 40H are adjusted. Similarly to the θ-adjustment, the relationship between the direction in which the eccentric pin 421 is rotated and the displacement direction of the base plate 41 generated by the rotation of the eccentric pin 421 depends on the design of the eccentric surface or the cam face. Due to the rotation of the eccentric pin 421, the longer the distance of the eccentric surface pushing the first pressure-receiving surface Sp1 from the central axis C of the eccentric pin 421 becomes, the more the distance between the central axis and the first pressure-receiving surface Sp1 is increased, and thus, the base plate 41 is displaced, in other words, retracted.

After the completion of the position adjustment of the jet holes 40H, the screws 46 are inserted into the screw holes 41SH as shown in FIG. 17 to fix the inkjet head 4 to the carriage 33. When attaching the plurality of inkjet heads 4 to the carriage 33, the position adjustment described above is repeated for each of the inkjet heads 4, and then, the fixation by screwing is performed. Such attachment of the inkjet heads 4 is performed when, for example, manufacturing the printer 1, and replacing the inkjet heads 4.

[Operations and Functions/Advantages]

(A. Basic Operation of Printer 1)

In the present embodiment, printing of images, characters, and so on to the recording paper P is performed by the printer 1. As an initial state, it is assumed that the four types of ink tanks 3 shown in FIG. 1 are sufficiently filled with the ink of the corresponding colors (the four colors), respectively. Further, there is established the state in which the inkjet heads 4 have already been filled with the ink of the corresponding colors.

In the initial state, when operating the printer 1, the grit rollers 21 in the carrying mechanisms 2*a*, 2*b* rotate, and the recording paper P is held between the grit rollers 21 and the pinch rollers 22 to thereby be carried in the carrying direction d (the X direction). At the same time as such a carrying operation, the electric motor 35 in the drive mechanism 34 is driven to rotate the pulleys not shown to thereby move the carriage 33 via the endless belt 36. The carriage 33 reciprocates in the width direction of the recording paper P (the Y direction) while being guided by the guide rails 31, 32. By arbitrarily ejecting the ink from the inkjet heads 4 to the recording paper P while changing the relative positional relationship between the recording paper P and the carriage 33 in such a manner as described above, the printing of the images, the characters, and so on to the recording paper P is achieved.

(B. Operation in Head Modules 40)

In the head modules 40, the flow channels of the ink 9 extending from the introduction port 44 toward the discharge port 45 are formed, and the ink is branched from the flow channels to be supplied to the plurality of jet holes 40H. Here, a part of the ink 9 introduced into the flow channels via the introduction port 44 flows through the flow channel toward the discharge port 45, and another part thereof is introduced into the jet holes 40H when performing recording, and is jetted toward the recording paper P.

(C. Functions/Advantages)

The liquid jet heads (the inkjet heads 4) according to the present embodiment each have the configuration described hereinabove, and the advantages obtained by the present embodiment will hereinafter be described.

First, the sleeve 425 is provided, the sleeve 425 is provided with the first pressure-receiving surface Sp1 facing to the displacement direction of the base plate 41, further the sleeve 425 is attached to the carriage pin 411, and at the same time, the eccentric pin 421 is made to have contact with the first pressure-receiving surface Sp1 of the sleeve 425. Thus, even when a shift occurs in the position of the eccentric pin 421 with respect to the carriage pin 411, for example, even when the shift occurs in a direction (specifically, a direction perpendicular to the displacement direction) other than the displacement direction of the base plate 41, due to the rotation of the eccentric pin 421 for the positioning, it becomes possible to perpendicularly push the first pressure-receiving surface Sp1 with the eccentric pin 421. Therefore, it is possible to displace the inkjet head 4, namely the jet holes 40H, in the desired direction (the displacement direction of the base plate 41, and in the present embodiment, the nozzle array direction in which the plurality of jet holes 40H is arranged) with respect to the carriage 33 irrespective on the shift in the positional relationship.

Second, the position adjustment mechanisms M1, M2 are disposed on the inner side of the outer edge 41E in the planar direction, for example, the planar direction of the X-Y plane on the base plate 41. Thus, since it becomes possible to achieve the reduction of the space occupied by the inkjet head 4, it is possible to dispose the inkjet heads 4 in a space-efficient manner.

It should be noted that the positions where the position adjustment mechanisms M1, M2 are disposed are not limited to the inner side of the outer edge 41E of the base plate 41, and it is possible to dispose the position adjustment mechanisms M1, M2 on the outer edge 41E, or on the outer side of the outer edge 41E. For example, it is possible to dispose the θ-adjustment section out of the position adjustment mechanism M1 on the inner side of the outer edge 41E on the one hand, and dispose the X-adjustment section or the eccentric pin 421 out of the position adjustment mechanism M1 on the outer side of the outer edge 41E on the other hand.

Third, the sleeve 425 is attached to the carriage pin 411, and the eccentric outer circumferential surface (the eccentric part 4212) of the eccentric pin 421 is made to have contact with the first pressure-receiving surface Sp1 of the sleeve 425. Thus, it becomes possible to transmit the function of the eccentricity based on the rotation of the carriage pin 411 to the carriage pin 411 in a more straightforward manner, and therefore, finer positioning of the jet holes 40H becomes possible.

Further, by adopting the cam pin 421*b* instead of the eccentric pin 421, and making the cam face provided to the outer circumference of the cam pin 421*b* have contact with the first pressure-receiving surface Sp1, it is possible to achieve an increase in the displacement of the base plate 41 and the jet holes 40H with respect to the carriage 33 while suppressing an increase in force necessary to rotate the cam pin 421*b* due to the nature of the cam. Further, when using the function of the cam, it is possible to suppress the displacement of the jet holes 40H per unit rotational angle of the cam pin 421*b* necessary to achieve a predetermined displacement of the jet holes 40H to a small amount to thereby make a contribution to the realization of more precise positioning.

Fourth, the sleeve 425 is provided with the locking part 4253 to lock the eccentric part 4112 of the eccentric pin 421 with the locking part 4253 from the distal side from the base plate 41, namely in the state in which the locking part 4253 overhangs the eccentric part 4112. Thus, it becomes possible to more surely avoid the separation of the eccentric pin 421 from the base plate 41, and therefore, it is possible to smoothly perform the positioning of the jet holes 40H.

Fifth, by monotonically changing the height of the cam provided to the cam pin 421*b* in the rotational direction of the cam pin 421*b*, the rotational angle of the cam pin 421*b* and the displacement of the base plate 41 due to the cam face become to correspond to each other, and therefore, it becomes possible to figure out the displacement of the jet holes 40H from the rotational angle of the cam pin 421*p*.

Sixth, the second pressure-receiving surface Sp2 facing to a different direction from the displacement direction of the base plate 41, the nozzle array direction in the present embodiment, is formed on an interior surface of the hole part H of the base plate 41, and the eccentric part 4112 of the carriage pin 411 is made to have contact with the second pressure-receiving surface Sp2. Thus, the positioning of the jet holes 40H toward the different direction from the direction of the position adjustment by the eccentric pin 421 becomes possible, and it is possible to dispose the jet holes 40H with higher accuracy with respect to the carriage 33.

Here, by setting the direction of the second pressure-receiving surface Sp2 to the direction perpendicular to the direction to which the first pressure-receiving surface Sp1 faces, namely the nozzle array direction, the position adjustment in a direction perpendicular to the nozzle array direction, for example, the rotational direction becomes possible in addition to the position adjustment in the nozzle array direction of the jet holes 40H.

Seventh, by disposing the display sections I1, I2 for displaying the displacement of the base plate 41 toward the displacement direction of the base image 41, it becomes possible to perform the position adjustment while checking the displacement of the jet holes 40H toward the nozzle array direction, and therefore, more accurate positioning of the jet holes 40H becomes possible.

2. Second Embodiment

In the embodiment described above, the sleeve 425 as a specific example of the "intermediary member" is attached to the member on the carriage 33 side out of the member (the carriage pin 411) on the carriage 33 side and the member (the eccentric pin 421) on the base plate 41 side. However, the arrangement of the intermediary member is not limited thereto, and it is possible to attach the intermediary member to the member on the base plate 41 side as another specific example.

In the present embodiment, as an example of such an aspect, a sleeve 431 as another specific example of the "intermediary member" is attached to the member on the base plate 41 side, for example, the eccentric pin 421.

It is substantially the same as in the embodiment described above that the position adjustment mechanisms M1, M2 are disposed in the positioning areas 41R located at the both ends of the base plate 41, and are different in configuration from each other. In other words, the θ-adjustment section is disposed in both of the positioning areas 41R, and the X-adjustment section is disposed in either one of the positioning areas 41R. The description will hereinafter be presented using the position adjustment mechanism M1 as a representative.

Figure 21:
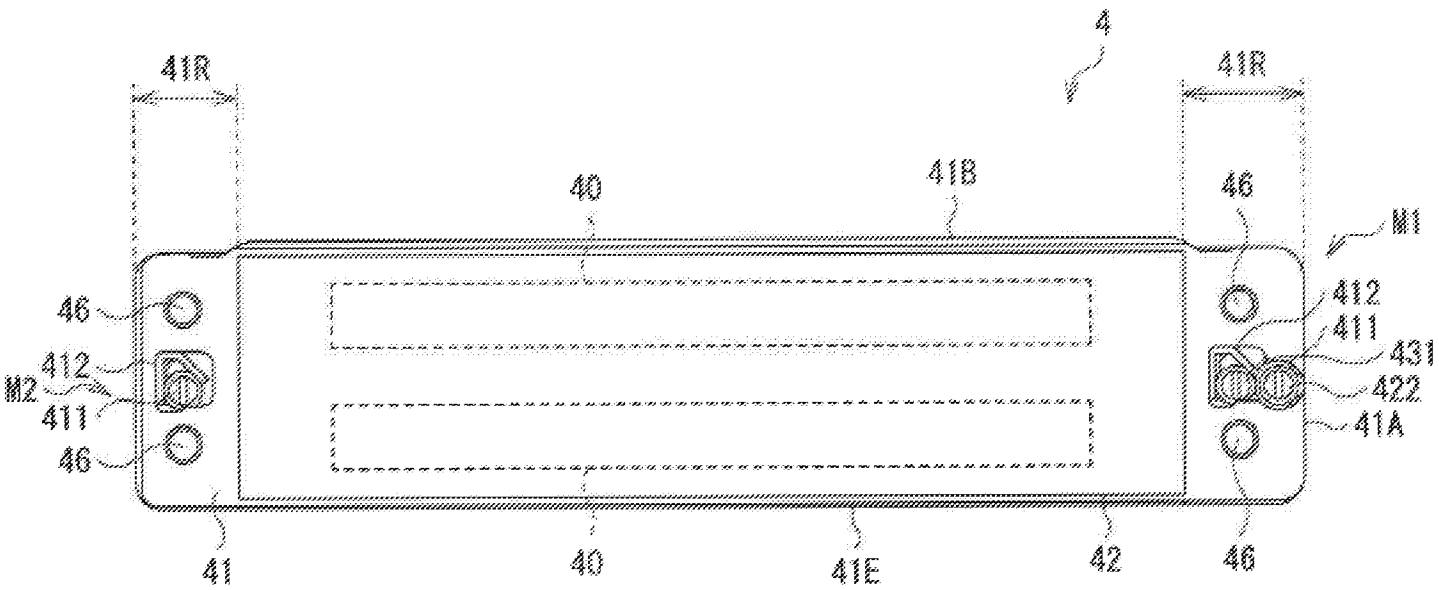
FIG. 21 is a plan view of an inkjet head provided to a printer according to another embodiment of the present disclosure.
Figure 22:
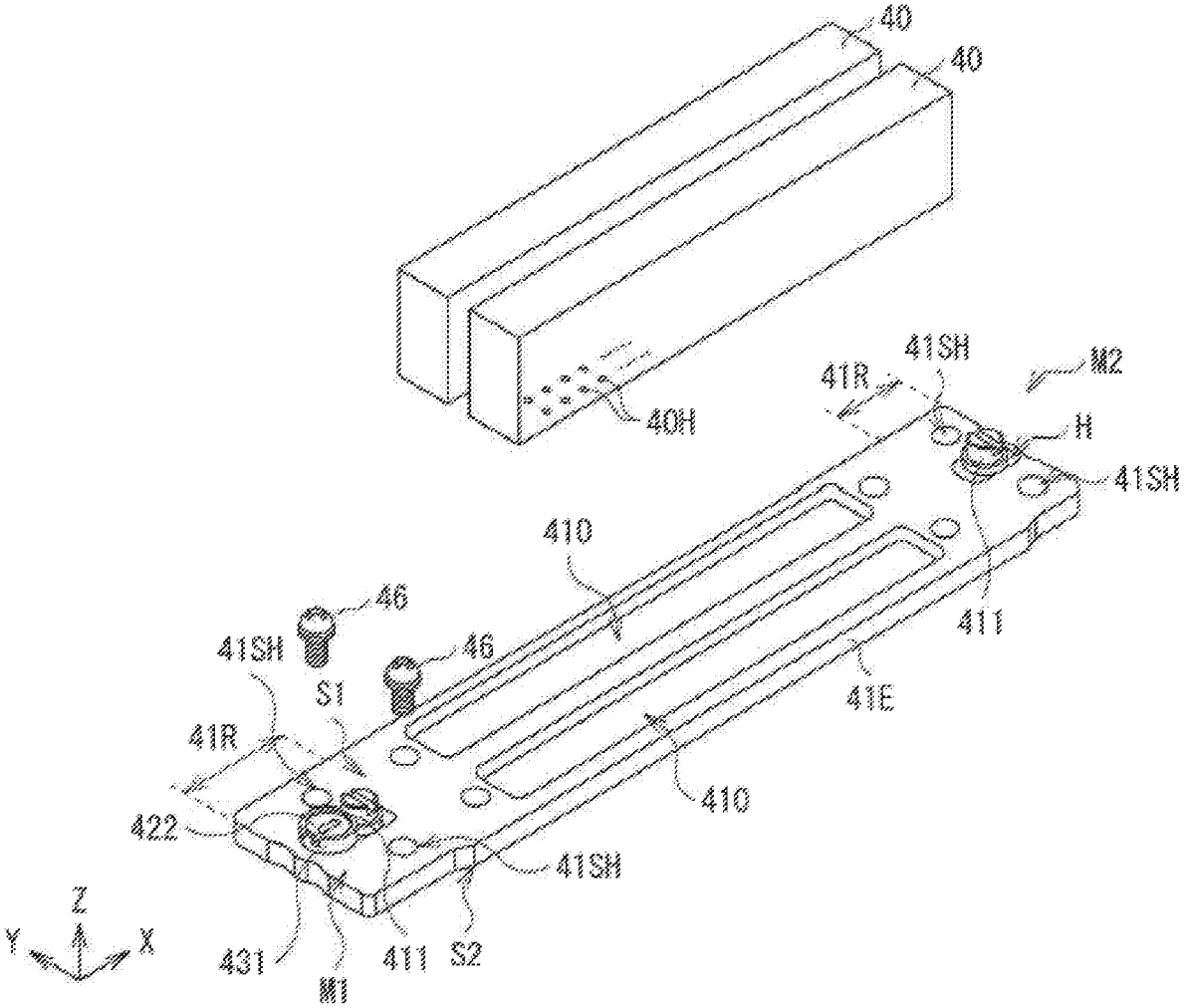
FIG. 22 is an exploded perspective view of the ink jet head shown in FIG. 21.
Figure 23:
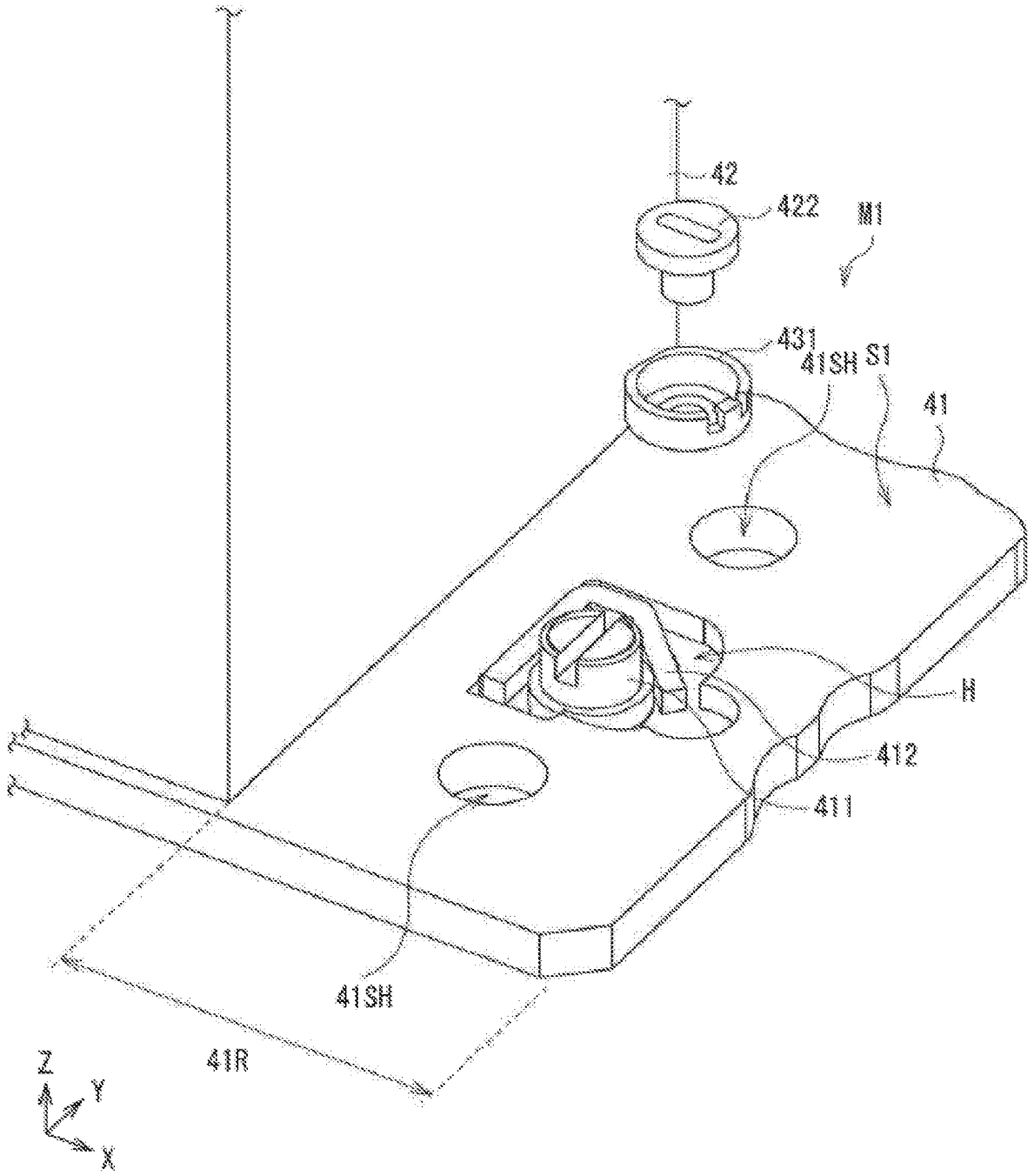
FIG. 23 is an exploded perspective view schematically showing a configuration of a position adjustment mechanism provided to the inkjet head shown in FIG. 21.
Figure 24:
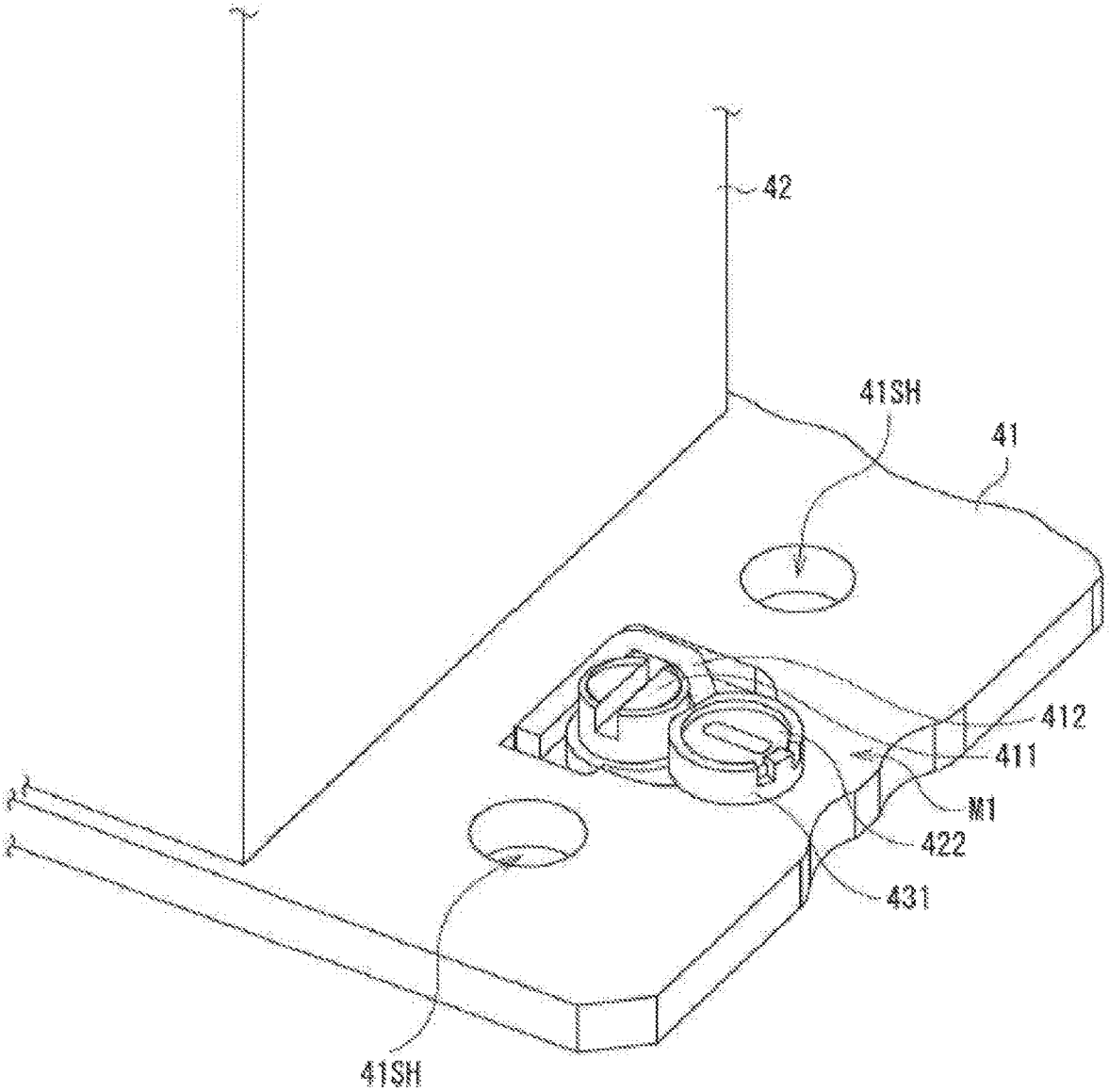
FIG. 24 is a perspective view showing an appearance of the position adjustment mechanism obtained by assembling the position adjustment mechanism shown in FIG. 23.
Figure 25:
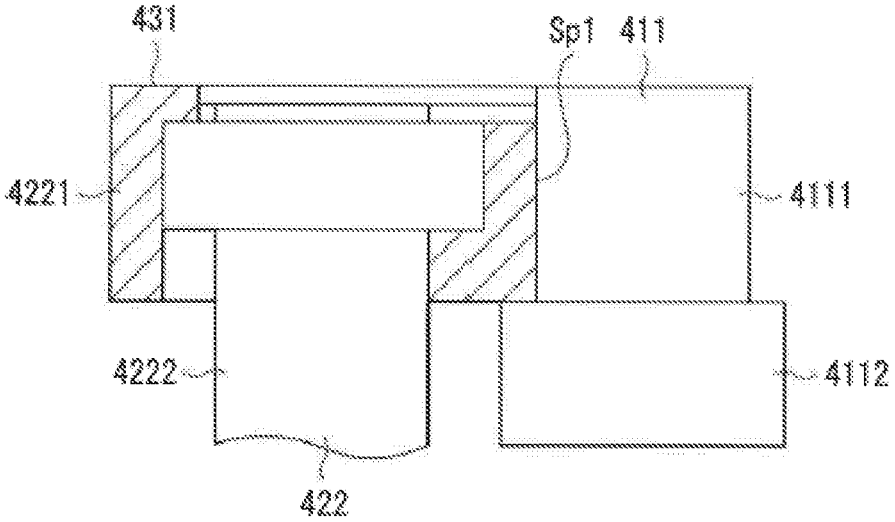
FIG. 25 is an enlarged partial cross-sectional view of an X-adjustment section of the position adjustment mechanism shown in FIG. 23.
Figure 26A:
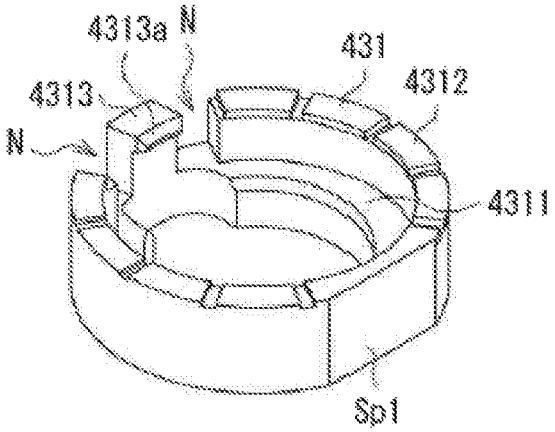
FIG. 26A and FIG. 26B are a top-side perspective view and a bottom-side perspective view of a sleeve provided to the X-adjustment section shown in FIG. 25, respectively.
Figure 26B:
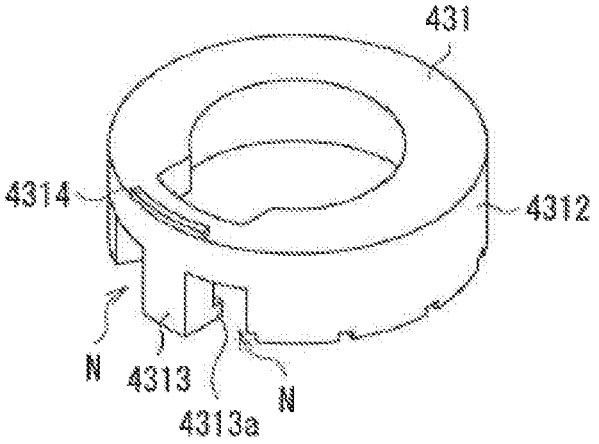

FIG. 21 and FIG. 22 show the configuration of the inkjet head 4 provided to the printer 1 according to the present embodiment. FIG. 21 shows the configuration of the inkjet head 4 with a plan view, and FIG. 22 shows the same with an exploded perspective view. FIG. 23 through FIG. 26B show the configuration of the position adjustment mechanism M1, wherein FIG. 23 shows it with an exploded perspective view, FIG. 24 shows it with a perspective view of the state of having been assembled, and FIG. 25 shows it with a cross-sectional view with a plane parallel to the central axis of an eccentric pin 422, respectively. FIGS. 26A and 26B show the configuration of the sleeve 431 with a top-side perspective view and a bottom-side perspective view.

In the present embodiment, the X-adjustment section of the position adjustment mechanism M1 is generally provided with the carriage pin 411 as a specific example of the "reference member," the eccentric pin 422 as a specific example of the "position adjustment member," and the sleeve 431 as a specific example of the "intermediary member." Out of these elements 411, 422, and 431, the configuration of the carriage pin 411 is basically the same as that in the embodiment described above.

(Eccentric Pin 422)

In the present embodiment, there is adopted the sleeve 431 to be attached to the eccentric pin 422 (specifically, an eccentric part 4221 thereof) instead of the sleeve 425 attached to the shaft part of the carriage pin 411. As shown in FIG. 23 and FIG. 25, the eccentric pin 422 is provided with the eccentric part 4221 and a shaft part 4222 extending below the eccentric part 4221, and the shaft part 4222 is inserted into a shaft hole provided to the base plate 41. The outside diameter of the shaft part 4222 is smaller than the outside diameter of the eccentric part 4221. Similarly to the embodiment described above, the eccentric pin 422 can rotate with respect to the base plate 41 in the state in which the shaft part 4222 is inserted in the shaft hole. The shaft part 4222 is inserted into the shaft hole to form the central axis of the rotation of the eccentric pin 422.

(Sleeve 431)

As shown in FIG. 26A, the sleeve 431 forms a rough cylindrical shape as a whole. The sleeve 431 has an annular extending part 4311 extending from an inner circumference inward in the radial direction at one end along the central axis. The annular extending part 4311 forms a seating surface for the eccentric part 4221 of the eccentric pin 422, and is held between the eccentric part 4221 and the obverse surface S1 of the base plate 41 in the state in which the sleeve 431 is attached to the eccentric part 4221. Thus, it is possible to fix the sleeve 431 to the base plate 41 in the direction of the central axis. A hook-like standing part 4313 separated from the rest with a pair of cutouts N is disposed in a circumferential wall 4312 of the sleeve 431, and the tip of the hook-like standing part 4313 slightly extends inward in the radial direction of the sleeve 431 from the interior surface forming the housing space of the eccentric part 4221. By an inward protruding part 4313*a* locking the eccentric part 4221, it is possible to prevent the sleeve 431 and the eccentric pin 422 from being separated from each other during the position adjustment with the X-adjustment section. Further, as shown in FIG. 26B, on the bottom surface of the sleeve 431, there is formed a tongue-like protruding part 4314 extending toward the distal side in parallel to the central axis of the sleeve 431. The tongue-like protruding part 4314 constitutes a specific example of a "rotation restriction part" related to the present disclosure, and engages with a part of the base plate 41 to restrict the rotation of the sleeve 431 with respect to the base plate 41 in the state in which the sleeve 431 is attached to the eccentric part 4221. In the present embodiment, the tongue-like protruding part 4314 engages with the outer edge part 41E of the sleeve.

The sleeve 431 is attached to the eccentric part 4221 so as to be able to rotate around the central axis (the central axis of the shaft part 4222) of the rotation of the eccentric pin 422 with respect to the eccentric pin 422. In other words, as shown in FIG. 25, the sleeve 431 surrounds the eccentric part 4221 with the circumferential wall thereof in the state of being attached. A part of the outer circumference of the sleeve 431 is formed to be flat, and the first pressure-receiving surface Sp1 parallel to the central axis of the sleeve 431 is formed of the flat surface. In the state in which the sleeve 431 is attached to the eccentric part 4221, the shaft part 4111 of the carriage pin 411 has contact with the first pressure-receiving surface Sp1.

Similarly to the embodiment described above, after the completion of the position adjustment in the rotational direction by the θ-adjustment section, the position adjustment in the translation direction, namely the nozzle array direction or the X direction, is performed by the X-adjustment section. By rotating the eccentric pin 422, the eccentric part 4221 rotates relatively to the sleeve 431. The eccentric action by the eccentric part 4221 reaches the carriage pin 411 via the first pressure-receiving surface Sp1 of the sleeve 431, and the base plate 41 and the jet holes 40H are displaced by the reactive force of that action.

As described above, according to the present embodiment, by attaching the sleeve 431 to the eccentric part 4221, and at the same time, making the outer circumferential surface of the carriage pin 411 have contact with the first pressure-receiving surface Sp1 of the sleeve 431, it becomes possible to displace the jet holes 40H in the desired direction (the nozzle array direction in the present embodiment) with respect to the carriage 33 irrespective of the shift in the positional relationship between the carriage pin 411 and the eccentric pin 422.

Further, since it becomes possible to apply the present embodiment to the existing carriage 33 having already been provided with the element (the carriage pin 411) for realizing a specific example of the "reference member," it is possible to implement the inkjet heads 4 and the printer 1 according to the present embodiment in a cost-effective manner.

Further, according to the present embodiment, by restricting the rotation of the sleeve 431 with respect to the base plate 41 with the tongue-like protruding part 4314, it becomes possible to keep the first pressure-receiving surface Sp1 of the sleeve 431 in a constant direction, and therefore, it is possible to more surely set the displacement direction of the jet holes 40H with respect to the carriage 33 to the desired direction.

In all of the embodiments described hereinabove, it is possible to make the sleeves 425, 431 from a different material from the material of the other member (the eccentric pin 421 to the sleeve 425, the carriage pin 411 to the sleeve 431) having contact with the first pressure-receiving surface Sp1. For example, by making the sleeves 425, 431 from a material softer than the other member, it is possible to suppress the abrasion occurring in the other member.

Further, since it becomes possible to form the sleeves 425, 431 from a material high in sliding property, it is possible to smoothly perform the position adjustment in the X direction with high accuracy. As a material applicable to the sleeves 425, 431, it is possible to cite POTICON (registered trademark). By applying POTICON, it is possible to enhance the sliding property of the sleeves 425, 431, and at the same time, it is possible to improve the abrasion resistance.

In the above description, regarding the position adjustment in the nozzle array direction, namely the X direction, it is assumed that the eccentric surface or the cam face is provided to the member on the base plate 41 side to transmit the action of the eccentricity or the cam to the member on the carriage 33 side via the first pressure-receiving surface of the sleeve. Such a configuration is not a limitation, and it is also possible to arrange that the eccentric surface or the like is provided to the member on the carriage 33 side, and the member on the base plate 41 side is displaced using the function of the eccentricity and so on to achieve the position adjustment of the jet holes 40H. For example, a sleeve having an annular shape is attached to a pin member on the base plate 41 side to make the eccentric surface or the cam face provided to the carriage pin 411 have contact with the first pressure-receiving surface of the sleeve.

Although in the above description, the positioning areas 41R are disposed in the both end parts in the long-side direction of the base plate 41, it is also possible to arrange to dispose the positioning area 41R in either one of the end parts in the long-side direction of the base plate 41. Further, it is also possible to dispose the positioning area 41R in an end part in the short-side direction besides the end parts in the long-side direction.

Further, although in the above description, there is cited the printer 1 (the inkjet printer) as a specific example of the "liquid jet recording device" according to the present disclosure, this example is not a limitation, and it is also possible to apply the present disclosure to printers of other types than the inkjet type, or other devices than the printer. In other words, the "liquid jet head" (the inkjet head 4 as a specific example thereof) according to the present disclosure can be applied to other devices than the inkjet printer. As an example to which the "liquid jet head" according to the present disclosure can be applied, it is possible to cite a device such as a facsimile device or an on-demand printing machine.

Some of the concepts which can be derived from the above description will be recited below.

<1> A liquid jet head to be installed in a carriage of a liquid jet recording device, the liquid jet head comprising: a nozzle section having a jet hole for liquid; a support member configured to support the nozzle section; and a position adjustment mechanism configured to adjust a position of the jet hole with respect to the carriage, wherein the position adjustment mechanism includes: a reference member, a position of which with respect to the carriage is fixable; a position adjustment member which is coupled to the support member, and is configured to push the reference member to change a relative distance with respect to the reference member to thereby displace the support member on the carriage; and an intermediary member intervening between the reference member and the position adjustment member, the intermediary member is attached to either one of the reference member and the position adjustment member to form a first pressure-receiving surface facing to a displacement direction of the support member, and the other of the reference member and the position adjustment member has contact with the first pressure-receiving surface.

<2> The liquid jet head according to <1>, wherein the support member has a through hole penetrating in a jetting direction of the liquid outside a support area of the nozzle section, the position adjustment mechanism is disposed on an inner side of an outer edge in a planar direction of the support member, and the reference member extends via the through hole.

<3> The liquid jet head according to <1> or <2>, wherein the reference member and the position adjustment member are pin members, central axes of which are disposed in parallel to each other, the intermediary member is attached to the reference member to form the first pressure-receiving surface parallel to the central axis of the reference member, the position adjustment member is rotatably coupled to the support member, and has one of an outer circumferential surface eccentric with respect to the central axis of the position adjustment member and a cam face provided to an outer circumference around the central axis of the position adjustment member, and one of the outer circumferential surface and the cam face of the position adjustment member has contact with the first pressure-receiving surface.

<4> The liquid jet head according to <3>, wherein the intermediary member has a locking part configured to lock an eccentric part of the position adjustment member having one of the outer circumferential surface being eccentric and the cam face from a distal side from the support member.

<5> The liquid jet head according to <3> or <4>, wherein in the position adjustment member, a height of cam as a distance from the central axis of the position adjustment member to the cam face monotonically increases or decreases in a rotational direction of the position adjustment member.

<6> The liquid jet head according to <1> or <2>, wherein the reference member and the position adjustment member are pin members, central axes of which are disposed in parallel to each other, the position adjustment member is rotatably coupled to the support member, and has an eccentric part having an outer circumferential surface eccentric with respect to the central axis of the position adjustment member, the intermediary member is attached to the eccentric part so as to rotate relatively to the position adjustment member to form the first pressure-receiving surface parallel to the central axis of the position adjustment member, and an outer circumferential surface of the reference member has contact with the first pressure-receiving surface.

<7> The liquid jet head according to <6>, wherein the intermediary member has a rotation restriction part configured to restrict a rotation of the intermediary member with respect to the support member.

<8> The liquid jet head according to any one of <1> to <7>, wherein the other of the reference member and the position adjustment member is made of a different material from a material of the intermediary member.

<9> The liquid jet head according to any one of <1> to <8>, further comprising a biasing member intervening between the reference member and the support member, wherein the support member has a hole part forming the through hole, and has a second pressure-receiving surface facing to a different direction from the displacement direction of the support member in an interior surface forming the hole part, the biasing member is fitted into the hole part, the reference member is rotatably coupled to the carriage, and has a second eccentric part having one of an outer circumferential surface eccentric with respect to a central axis of the rotation and a cam face provided to an outer circumference around the central axis of the rotation, one of the outer circumferential surface and the cam face of the second eccentric part has contact with the second pressure-receiving surface, and the biasing member biases the support member toward a direction of a reactive force received by the second eccentric part from the second pressure-receiving surface of the support member.

<10> The liquid jet head according to <9>, wherein the nozzle section has a plurality of the jet holes arranged in a predetermined nozzle array direction, the first pressure-receiving surface faces to the nozzle array direction as the displacement direction of the support member, and the second pressure-receiving surface faces to a direction perpendicular to the nozzle array direction.

<11> The liquid jet head according to anyone of <1> to <10>, further comprising a display section configured to display a displacement of the support member toward the displacement direction of the support member.

<12> A liquid jet recording device comprising: the liquid jet head according to anyone of <1> to <11>; the carriage to which the liquid jet head is attached; and a drive mechanism configured to move the carriage with respect to a print medium.

<13> A liquid jet head to be installed in a carriage of a liquid jet recording device, the liquid jet head comprising: a nozzle section having a jet hole for liquid; a support member configured to support the nozzle section; and a position adjustment mechanism configured to adjust a position of the jet hole with respect to the carriage, wherein the position adjustment mechanism includes: a reference member, a position of which with respect to the carriage is fixable; a movable member which is coupled to the support member, and is configured to move together with the support member to change a relative position to the carriage; and an intermediary member intervening between the reference member and the movable member, the intermediary member is attached to either one of the reference member and the movable member to form a first pressure-receiving surface facing to a displacement direction of the support member, the other of the reference member and the movable member has contact with the first pressure-receiving surface to push the first pressure-receiving surface in the displacement direction, and the movable member moves the support member on the carriage based on one of a force received by the movable member as a reactive force from the first pressure-receiving surface and a force received by the movable member via the first pressure-receiving surface.

What is claimed is:

1. A liquid jet head to be installed in a carriage of a liquid jet recording device, the liquid jet head comprising:

a nozzle section having a jet hole for liquid;

a support member configured to support the nozzle section; and a position adjustment mechanism configured to adjust a position of the jet hole with respect to the carriage, wherein the position adjustment mechanism includes:

a reference member, a position of which with respect to the carriage is fixable;

a position adjustment member which is coupled to the support member, and is configured to push the reference member to change a relative distance with respect to the reference member to thereby displace the support member on the carriage; and an intermediary member intervening between the reference member and the position adjustment member, the intermediary member is attached to either one of the reference member and the position adjustment member to form a first pressure-receiving surface facing to a displacement direction of the support member, another of the reference member and the position adjustment member has contact with the first pressure-receiving surface;

the reference member and the position adjustment member are pin members, central axes of which are disposed in parallel to each other, the intermediary member is attached to the reference member to form the first pressure-receiving surface parallel to the central axis of the reference member, the position adjustment member is rotatably coupled to the support member, and has one of an outer circumferential surface eccentric with respect to the central axis of the position adjustment member and a cam face provided to an outer circumference around the central axis of the position adjustment member, one of the outer circumferential surface and the cam face of the position adjustment member has contact with the first pressure-receiving surface, and a position adjustment of the liquid jet head in a translational direction is performed by rotation of the position adjustment member.

2. The liquid jet head according to claim 1, wherein the support member has a through hole penetrating in a jetting direction of the liquid outside a support area of the nozzle section, the position adjustment mechanism is disposed on an inner side of an outer edge in a planar direction of the support member, and the reference member extends via the through hole.

3. The liquid jet head according to claim 1, wherein the intermediary member has a locking part configured to lock an eccentric part of the position adjustment member having one of the outer circumferential surface being eccentric and the cam face from a distal side from the support member.

4. The liquid jet head according to claim 1, wherein in the position adjustment member, a height of cam as a distance from the central axis of the position adjustment member to the cam face monotonically increases or decreases in a rotational direction of the position adjustment member.

5. A liquid jet head configured to be installed in a carriage of a liquid jet recording device, the liquid jet head comprising:

a nozzle section having a jet hole for liquid;

a support member configured to support the nozzle section; and a position adjustment mechanism configured to adjust a position of the jet hole with respect to the carriage, wherein the position adjustment mechanism includes:

a reference member, a position of which with respect to the carriage is fixable:

a position adjustment member which is coupled to the support member, and is configured to push the reference member to change a relative distance with respect to the reference member to thereby displace the support member on the carriage; and an intermediary member intervening between the reference member and the position adjustment member, the intermediary member is attached to either one of the reference member and the position adjustment member to form a first pressure-receiving surface facing to a displacement direction of the support member, the other of the reference member and the position adjustment member has contact with the first pressure-receiving surface, the reference member and the position adjustment member are pin members, central axes of which are disposed in parallel to each other, the position adjustment member is rotatably coupled to the support member, and has an eccentric part having an outer circumferential surface eccentric with respect to the central axis of the position adjustment member, the intermediary member is attached to the eccentric part so as to rotate relatively to the position adjustment member to form the first pressure-receiving surface parallel to the central axis of the position adjustment member, an outer circumferential surface of the reference member has contact with the first pressure-receiving surface, and a position adjustment of the liquid jet head in a translational direction is performed by rotation of the position adjustment member.

6. The liquid jet head according to claim 5, wherein the intermediary member has a rotation restriction part configured to restrict a rotation of the intermediary member with respect to the support member.

7. The liquid jet head according to claim 1, wherein the other of the reference member and the position adjustment member is made of a different material from a material of the intermediary member.

8. The liquid jet head according to claim 1, further comprising a biasing member intervening between the reference member and the support member, wherein the support member has a hole part forming the through hole, and has a second pressure-receiving surface facing to a different direction from the displacement direction of the support member in an interior surface forming the hole part, the biasing member is fitted into the hole part, the reference member is rotatably coupled to the carriage, and has a second eccentric part having one of an outer circumferential surface eccentric with respect to a central axis of the rotation and a cam face provided to an outer circumference around the central axis of the rotation, one of the outer circumferential surface and the cam face of the second eccentric part has contact with the second pressure-receiving surface, and the biasing member biases the support member toward a direction of a reactive force received by the second eccentric part from the second pressure-receiving surface of the support member.

9. The liquid jet head according to claim 8, wherein the nozzle section has a plurality of the jet holes arranged in a predetermined nozzle array direction, the first pressure-receiving surface faces to the nozzle array direction as the displacement direction of the support member, and the second pressure-receiving surface faces to a direction perpendicular to the nozzle array direction.

10. The liquid jet head according to claim 1, further comprising a display section configured to display a displacement of the support member toward the displacement direction of the support member.

11. A liquid jet recording device comprising:

the liquid jet head according to claim 1;

the carriage to which the liquid jet head is attached; and a drive mechanism configured to move the carriage with respect to a print medium.

12. The liquid jet head according to claim 5, wherein the support member has a through hole penetrating in a jetting direction of the liquid outside a support area of the nozzle section, the position adjustment mechanism is disposed on an inner side of an outer edge in a planar direction of the support member, and the reference member extends via the through hole.

13. The liquid jet head according to claim 5, wherein the other of the reference member and the position adjustment member is made of a different material from a material of the intermediary member.

14. The liquid jet head according to claim 5, further comprising a biasing member intervening between the reference member and the support member, wherein the support member has a hole part forming the through hole, and has a second pressure-receiving surface facing to a different direction from the displacement direction of the support member in an interior surface forming the hole part, the biasing member is fitted into the hole part, the reference member is rotatably coupled to the carriage, and has a second eccentric part having one of an outer circumferential surface eccentric with respect to a central axis of the rotation and a cam face provided to an outer circumference around the central axis of the rotation, one of the outer circumferential surface and the cam face of the second eccentric part has contact with the second pressure-receiving surface, and the biasing member biases the support member toward a direction of a reactive force received by the second eccentric part from the second pressure-receiving surface of the support member.

15. The liquid jet head according to claim 14, wherein the nozzle section has a plurality of the jet holes arranged in a predetermined nozzle array direction, the first pressure-receiving surface faces to the nozzle array direction as the displacement direction of the support member, and the second pressure-receiving surface faces to a direction perpendicular to the nozzle array direction.

16. The liquid jet head according to claim 5, further comprising a display section configured to display a displacement of the support member toward the displacement direction of the support member.

17. A liquid jet recording device comprising:

liquid jet head according to claim 5;

the carriage to which the liquid jet head is attached; and a drive mechanism configured to move the carriage with respect to a print medium.

* * * * *